US010401048B2

(12) United States Patent
Rockwood et al.

(10) Patent No.: US 10,401,048 B2
(45) Date of Patent: Sep. 3, 2019

(54) AIR FLOW MIXER

(71) Applicant: TRANE INTERNATIONAL INC., Piscataway, NJ (US)

(72) Inventors: William B. Rockwood, Onalaska, WI (US); Wilson Samuel Jesudason Lawrence, Bangalore (IN); Abhijith Balakrishna, Bangalore (IN); Yahia Abdelhamid, Onalaska, WI (US); Jerry W. McClead, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 361 days.

(21) Appl. No.: 14/814,769

(22) Filed: Jul. 31, 2015

(65) Prior Publication Data

US 2016/0033159 A1 Feb. 4, 2016

(30) Foreign Application Priority Data

Jul. 31, 2014 (IN) ..... 3767/CHE/2014

(51) Int. Cl.
*F24F 13/04* (2006.01)
*F15D 1/02* (2006.01)

(52) U.S. Cl.
CPC ..... *F24F 13/04* (2013.01)

(58) Field of Classification Search
USPC ..... 454/261, 265, 266, 267, 268
See application file for complete search history.

(56) References Cited

U.S. PATENT DOCUMENTS

| | | | | |
|---|---|---|---|---|
| 3,212,424 | A | 10/1965 | Davis | |
| 3,390,623 | A | 7/1968 | Pierce | |
| 3,507,356 | A * | 4/1970 | Smith | F15D 1/0015 181/224 |
| 4,793,247 | A * | 12/1988 | Verweij | B01F 5/0082 366/336 |
| 5,368,521 | A | 11/1994 | Koenig | |
| 5,463,967 | A | 11/1995 | Gielow et al. | |
| 5,988,263 | A | 11/1999 | Schwarz | |
| 6,139,425 | A | 10/2000 | Yazici et al. | |
| 6,478,671 | B2 | 11/2002 | Murai et al. | |
| 6,547,433 | B2 | 4/2003 | Yazici et al. | |
| 6,612,923 | B1 | 9/2003 | Flynn | |
| 2005/0056313 | A1 * | 3/2005 | Hagen | B01F 5/0453 137/3 |
| 2008/0153409 | A1 * | 6/2008 | Koop | B01F 3/02 454/261 |

* cited by examiner

*Primary Examiner* — Gregory L Huson
*Assistant Examiner* — Elizabeth M. May
(74) *Attorney, Agent, or Firm* — Hamre, Schumann, Mueller & Larson, P.C.

(57) ABSTRACT

An air flow mixer that mixes two or more air streams that may enter air moving equipment at significantly different temperatures. In particular, methods, systems and apparatuses are disclosed that are directed to an air flow mixer that is structured and arranged to promote cross flow of portions of the air streams relative to each other through the air flow mixer. The cross flow resulting from the structure and arrangement of the air flow mixer avoids sharp delineations or fluid borders between the air streams that can be caused, for example, by a relatively higher temperature of one of the air streams and a relatively lower temperature of another one of the air streams.

14 Claims, 18 Drawing Sheets

AIR FLOW MIXER

FIELD

Embodiments disclosed herein relate generally to an air flow mixer that mixes two or more air streams that may enter air moving equipment at significantly different temperatures. In particular, methods, systems and apparatuses are disclosed that are directed to an air flow mixer that is structured and arranged to promote cross flow of portions of the air streams relative to each other through the air flow mixer.

BACKGROUND

Air streams enter air moving equipment, such as for example that may be employed in heating, ventilation, and air conditioning (HVAC) systems (including for example HVAC air handling units and/or related equipment thereof). Air streams can enter air moving equipment at dramatically different temperatures. Such a situation can occur for example in air moving equipment which uses outdoor air as one air source along with return air as another air source, and which is at a different temperature than the outdoor air. Different air streams have a natural tendency to segregate themselves. When air streams of significantly different temperatures and are merged, sharp delineations can exist between the different air streams due for example to the nature of the air streams having significantly different temperatures, unless the air temperature is not caused to be more evenly distributed.

SUMMARY

The air flow mixers described herein can provide an efficient approach to mixing two or more air streams which enter air moving equipment, such as where the air streams enter the air moving equipment at dramatically different temperatures.

If the air streams are not sufficiently mixed, such equipment may be susceptible to or may experience freezing problems, such as for example of heat exchanger coils sometimes present in such equipment. Such a situation can occur for example in air moving equipment which accepts outdoor air, and particularly for example when outdoor air is significantly colder relative to return air that is relatively warmer and sourced for example from indoor air.

Earlier or previously used mixing boxes, including for example air blenders, can be expensive and add additional overall footprint for a unit, sometimes taking up considerable space, due to the need of some depth or dimension to allow the air blender to work as intended and to allow mixing downstream.

In particular, methods, systems apparatuses, and embodiments described herein are generally directed to including an air flow mixer that mixes two or more air streams that may enter air moving equipment at significantly different temperatures, while reducing the additional footprint increase usually resulting from traditional mixing boxes and their potentially accompanying air blenders. The air flow mixer achieves this through a structure and arrangement that promotes cross flow of the air streams.

Air flow mixers herein are structured and arranged to promote cross flow of portions of the air streams relative to each other through the air flow mixer. The cross flow resulting from the structure and arrangement of the air flow mixer avoids sharp delineations between the segregated air streams or fluid borders between the segregated air streams due to the natural patterns of air flows with different temperatures, and/or removes sharp delineations or fluid borders that may be present between the air streams that are not mixed together, where such sharp delineations or fluid borders can be caused for example by a relatively higher temperature of one of the air streams and a relatively lower temperature of another one of the air streams. The terms "sharp delineations" or "fluid borders" refers to the natural tendency of air flows to be segregated, for example when they are put together such as but not by way of limitation when they are merged. In particular when the air flows or air streams have significantly different temperatures, such sharp delineations can be present in the merged air flows, or fluid borders can be present where the different flows are well defined and not evenly distributed or mixed.

In one embodiment, an air flow mixer includes a frame configured to promote mix of air flow. The frame includes first members extending in a first direction, and second members extending in a second direction, where the first and second members can make up the frame. The first members are structured and arranged to define first channels through the frame. The second members are structured and arranged to define second channels through the frame. The first members are structured and arranged to extend across the second direction that the second members extend. The second members are structured and arranged to extend across the first direction that the first members extend. The first members include blocking surfaces relative to the second direction. The second members include blocking surfaces relative to the first direction.

In some embodiments, any one or more of the first members are structured and arranged so as to be adjacent to one or more of the second channels, and the second members are structured and arranged so as to be adjacent to one or more of the first channels.

In some embodiments, the first members are structured and arranged to extend at least one of over and under the second channels, and the second members are structured and arranged to extend at least one of over and under the first channels.

In some embodiments, the blocking surfaces of the first members are configured to block air flow along the second direction over and under the second channels, and the blocking surfaces of the second members are configured to block air flow along the first direction over and under the first channels.

In one embodiment, the first channels are configured to receive a first air flow or air stream that is generally at one temperature. The second channels are configured to receive a second air flow or air stream that is generally at another temperature. In some embodiments, the temperature of the first air flow and the temperature of the second air flow may differ by, for example but not limited to, several tens of degrees, e.g. degrees Fahrenheit.

In one embodiment, the first channels are configured to allow air flow at the one temperature, and the second channels are configured to allow air flow at another temperature, where the first channels are adjacent to the second channels. In some embodiments, the air flow through any one channel of the first channels is exposed to the air flow through any one or more than one of the channels of the second channels. In some embodiments, the air flow through any one channel of the second channels is exposed to the air flow through any one or more than one of the channels of the first channels.

In some embodiments, the first channels create streams of air and the second channels create streams of air. The streams of air of the first channels flow over and under the streams of air of the second channels, and the streams of air of the second channels flow over and under the streams of air of the first channels, where one or more of the first streams of air are exposed to one or more of the second streams of air, and where one or more of the second streams of air are exposed to one or more of the first streams of air.

In some embodiments, the first streams of air can be configured as one or more layers of air and the second streams of air can be configured as one or more layers of air, where one or more of the layers of air of the first stream are exposed to one or more of the layers of the second stream, and where one or more of the layers of air of the second stream are exposed to one or more of the layers of the first stream.

In some embodiments, the air flow mixer promotes cross flow and intermixing of two or more air flows or air streams, through an interleaved or interweaved structure.

In some embodiments, one or both of the first members and second members are structured and arranged as blade or blade-like structures. In some embodiments, several blades are arranged upwardly and from side to side, where the channels are defined by the spacing of the blades.

In some embodiments, one or both of the first members and second members are structured and arranged as several comb-like structures.

In some embodiments, any one or more of the first members and the second members are structured and arranged to include perforations therethrough.

In some embodiments, any one or more of the first and second members include a top cover or panel. In some embodiments, one or both of the first members and second members include a bottom cover or panel. In some embodiments, where both the top and bottom panel are used for any one channel, such channel may resemble a closed channel or structure, where air flow is not exposed to air flow present outside the closed channel.

In some embodiments, any of the air flow mixers herein and structures thereof can include one or more panels, where the panels are configured as flow directors or guides into any one or more of the first and second channels.

In some embodiments, any of the air flow mixers herein and structures thereof may be implemented in air moving equipment, such as may be used in an HVAC unit and/or system. Air moving equipment can include but is not limited to various air handling units and/or systems and various heat pipe units and/or systems.

In some embodiments, any of the air flow mixers herein and structures thereof may be located or otherwise disposed at inlets or proximate inlets of two or more air flows, for example an intersection or junction area downstream of the inlets. In some embodiments, any of the air flow mixers may be upstream of a heat exchange coil and within in-unit duct structures. In some embodiments, such in-duct structures are existing in-unit duct structures, where no additional duct is needed.

DRAWINGS

These and other features, aspects, and advantages of the air flow mixer will become better understood when the following detailed description is read with reference to the accompanying drawing, wherein:

FIG. 2A is a perspective view showing the air handler unit with air blender and FIG. 2B is a perspective view of the air blender alone.

Figure 3A:
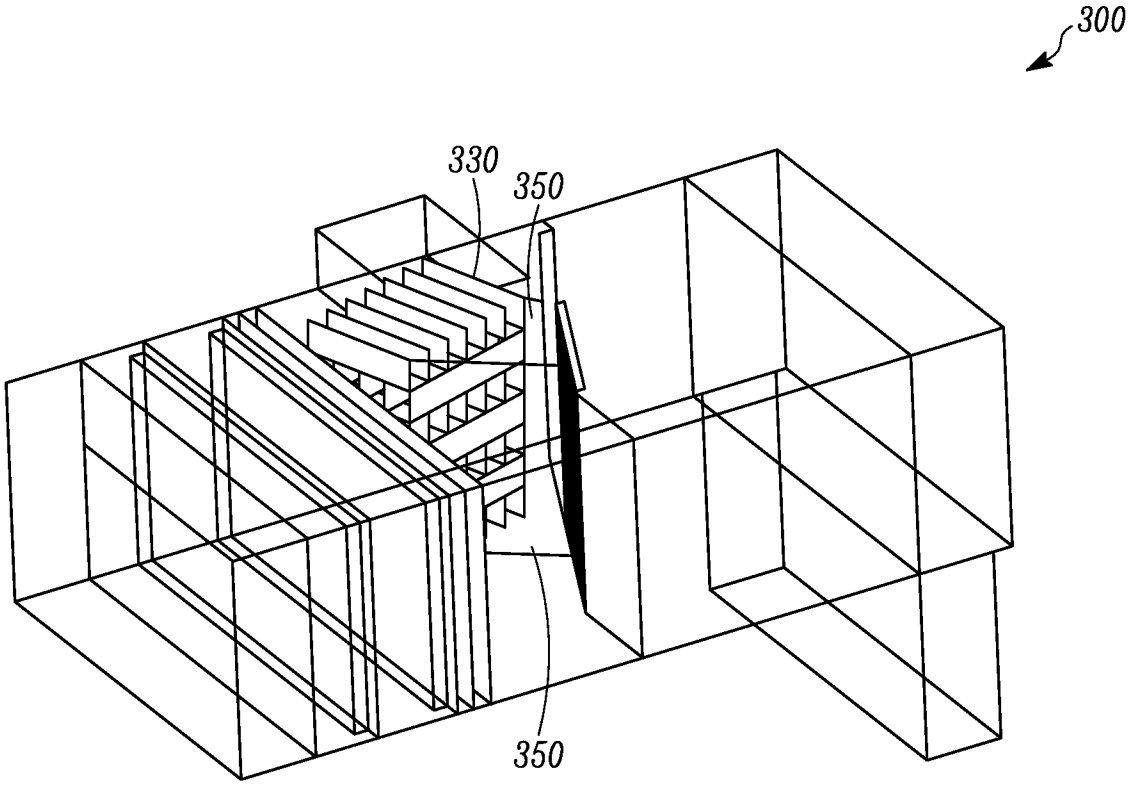
Figure 3B:
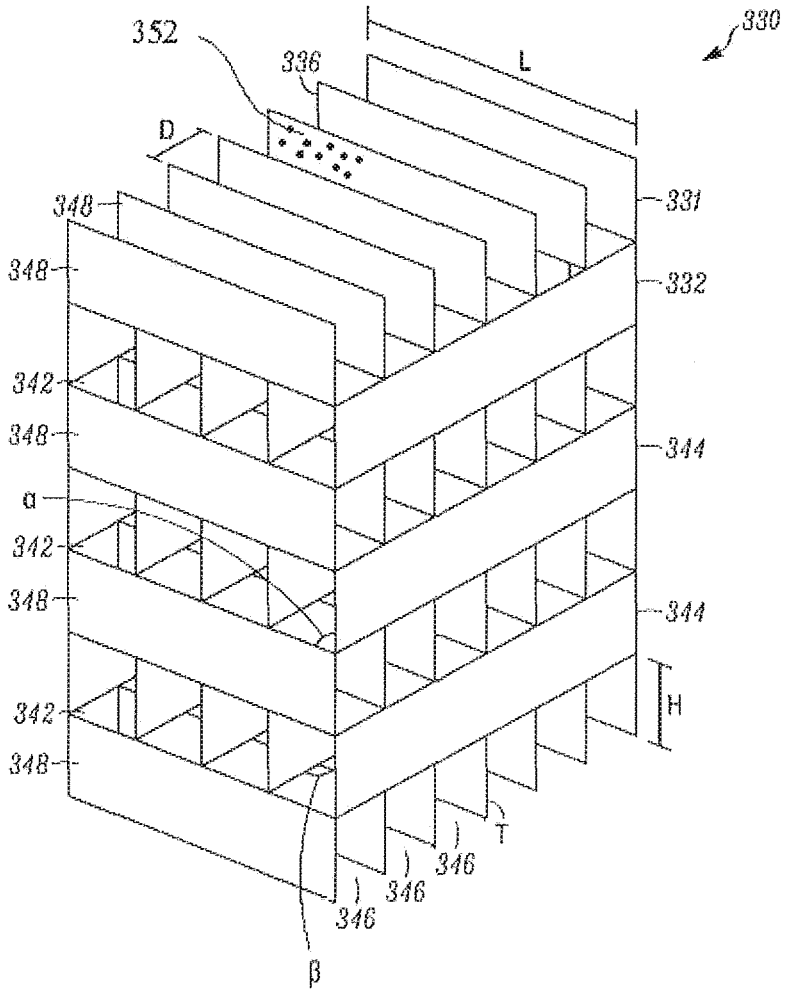
Figure 3C:
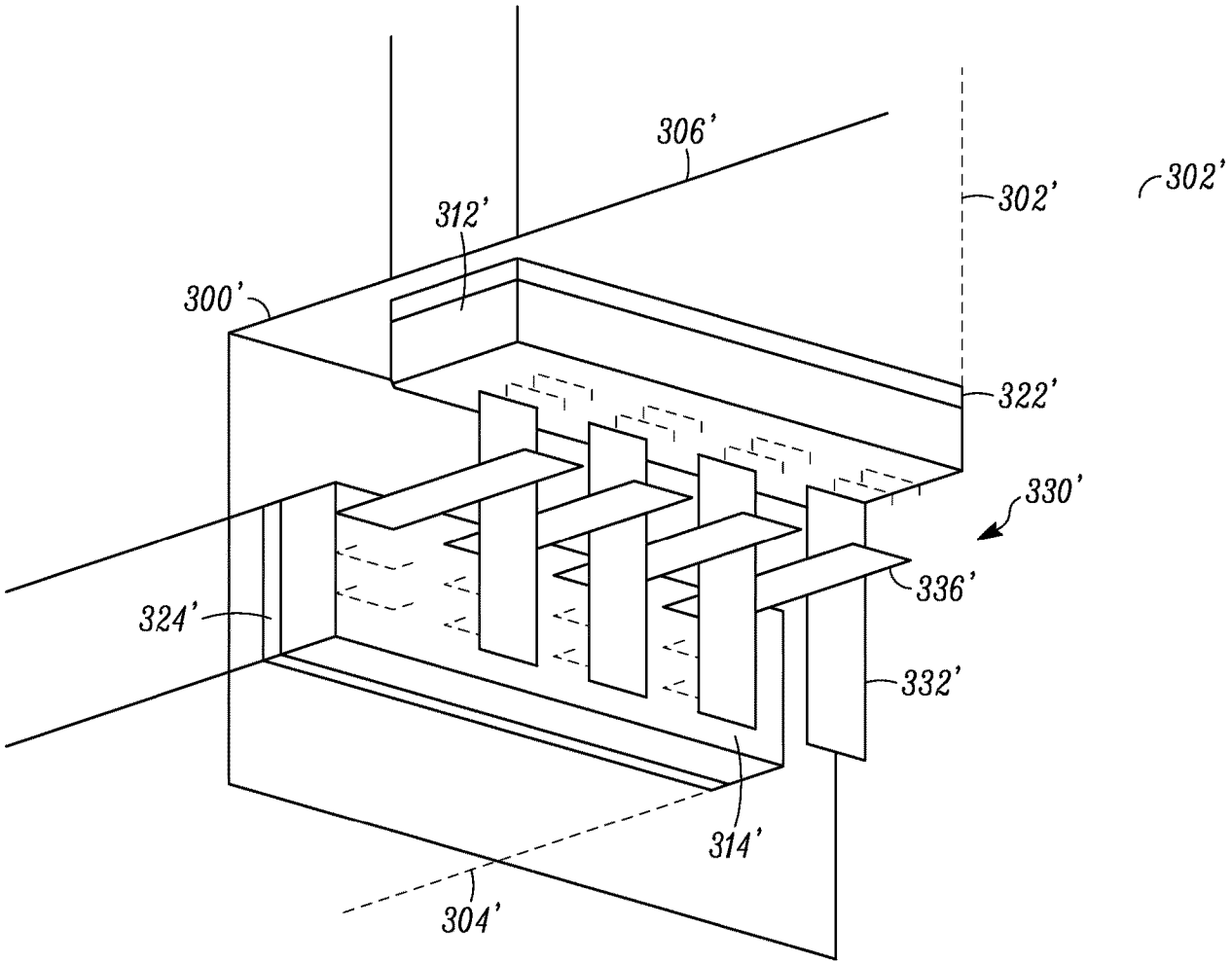

FIGS. 3A to C show examples of an air flow mixer according to the principles herein, details of which are also described further below and also illustrated in further drawings herein. FIG. 3A is a perspective view an air flow mixer implemented in the air handler unit configuration of FIG. 1. FIG. 3B is a relative close-up perspective view of the air flow mixer shown in FIG. 3A. FIG. 3C shows another embodiment of an air flow mixer having substantially similar features as the air flow mixer shown in FIGS. 3A and 3B.

Figure 4A:
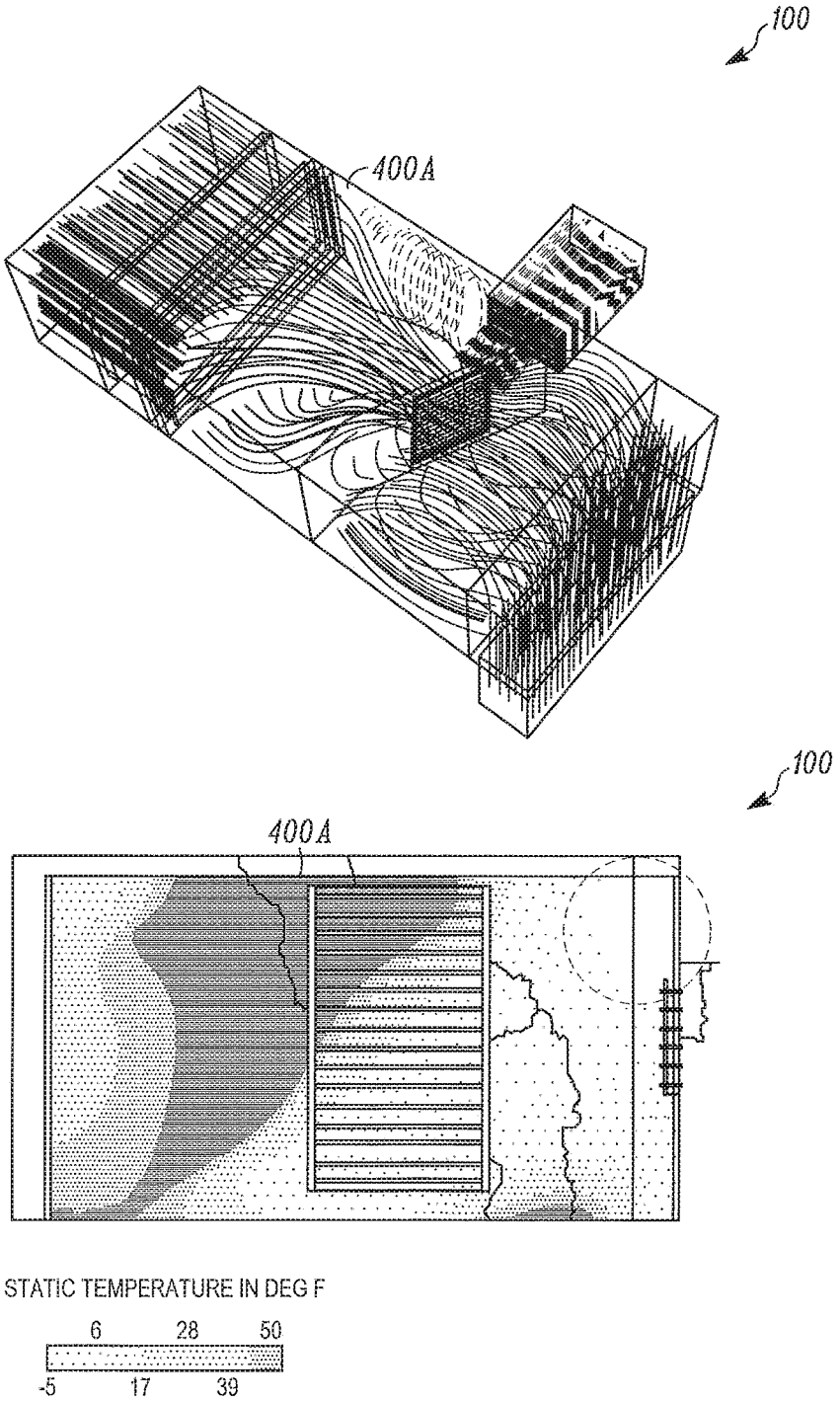
FIG. 4A PRIOR ART
Figure 4B:
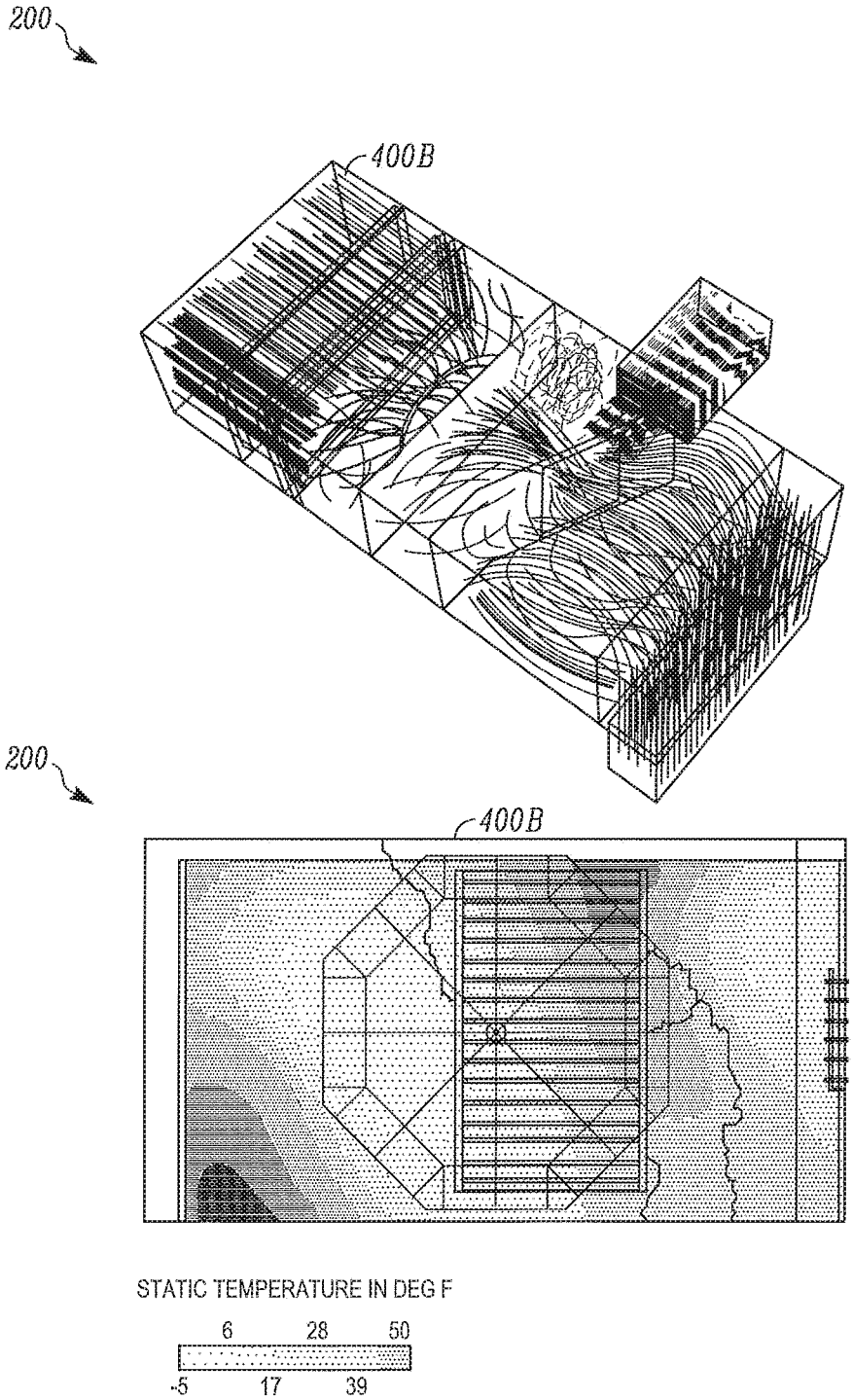
FIG. 4B PRIOR ART
Figure 4C:
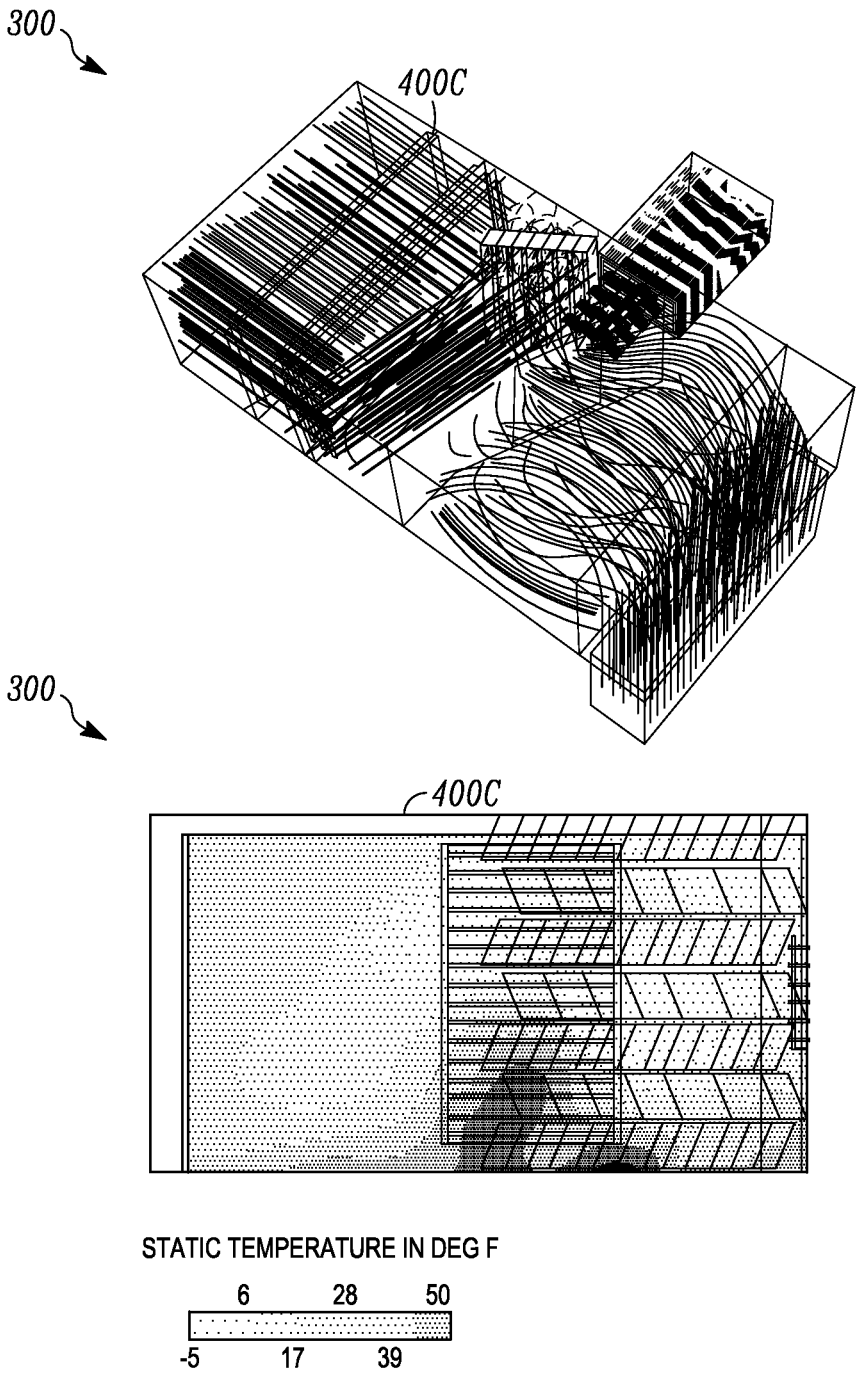

FIGS. 4A-C show simulated air flow patterns. FIG. 4A shows air flow patterns and temperature distributions in a conventional baseline unit (e.g. as in FIG. 1) without an air blender or air flow mixer. FIG. 4B shows air flow patterns and temperature distributions in a unit that has an air blender (e.g. the air blender as in FIGS. 2A and 2B). FIG. 4C shows air flow patterns and temperature distributions in a unit that has an air flow mixer as described herein (e.g. as the air flow mixer in FIGS. 3A to 3C).

Figure 5:
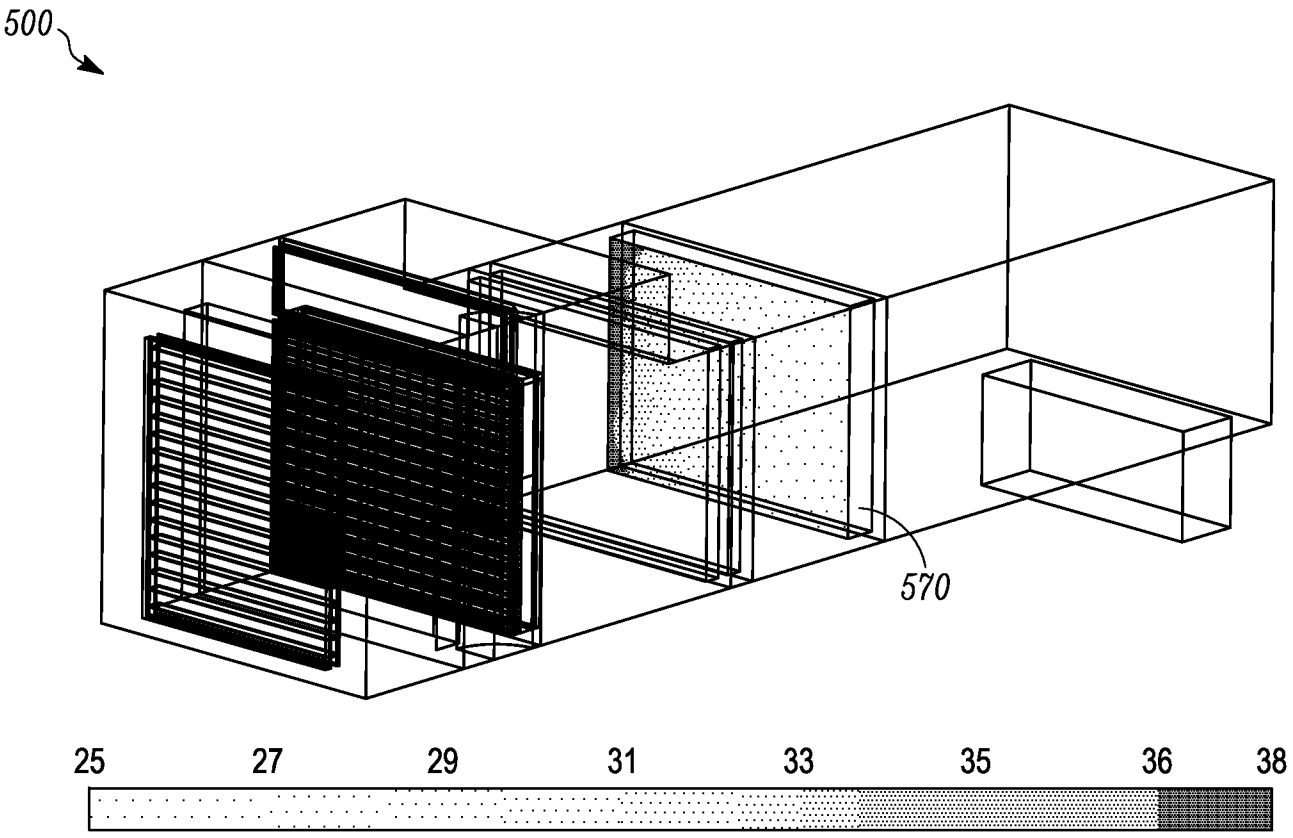

FIG. 5 shows a side-to-side temperature imbalance, for example that may occur downstream of a heat pipe installation.

Figure 6A:
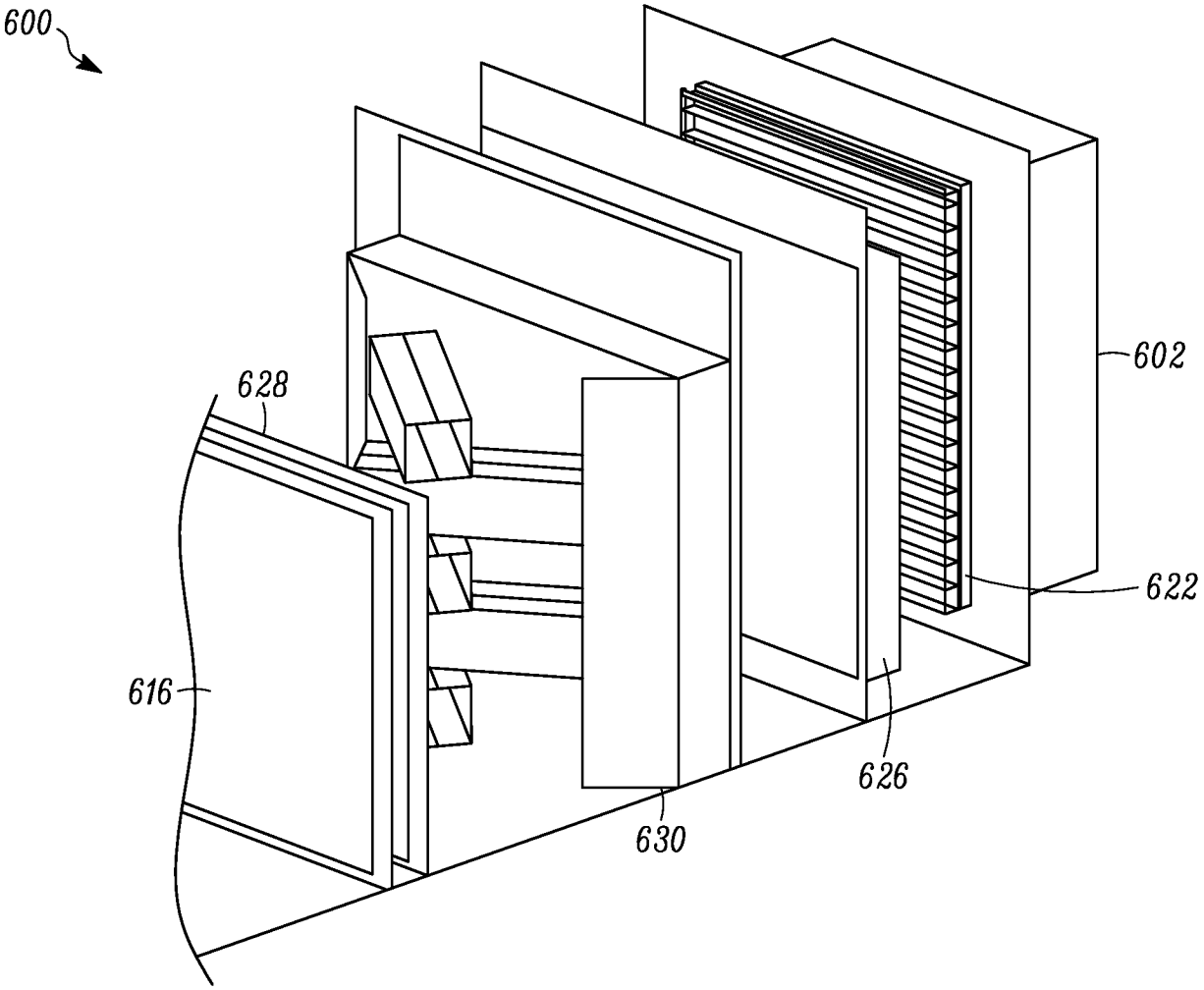
Figure 6B:
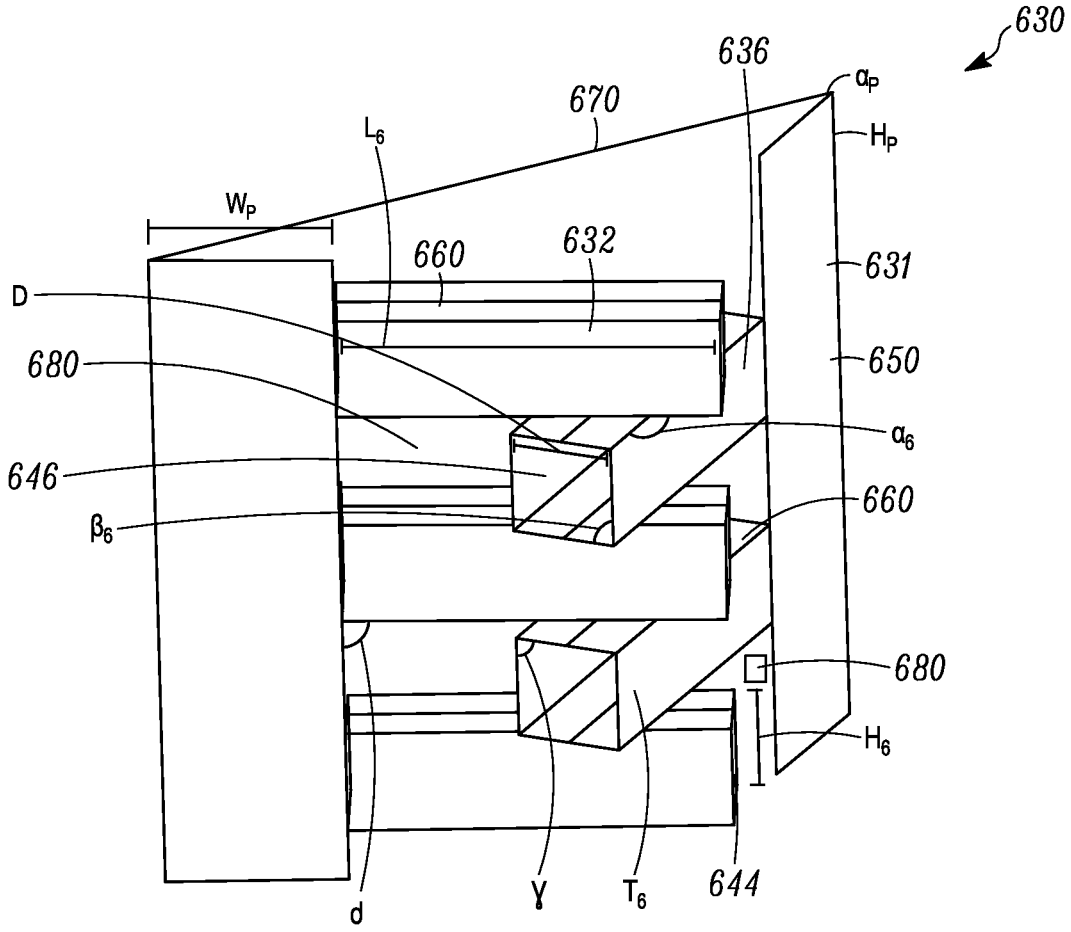
Figure 6C:
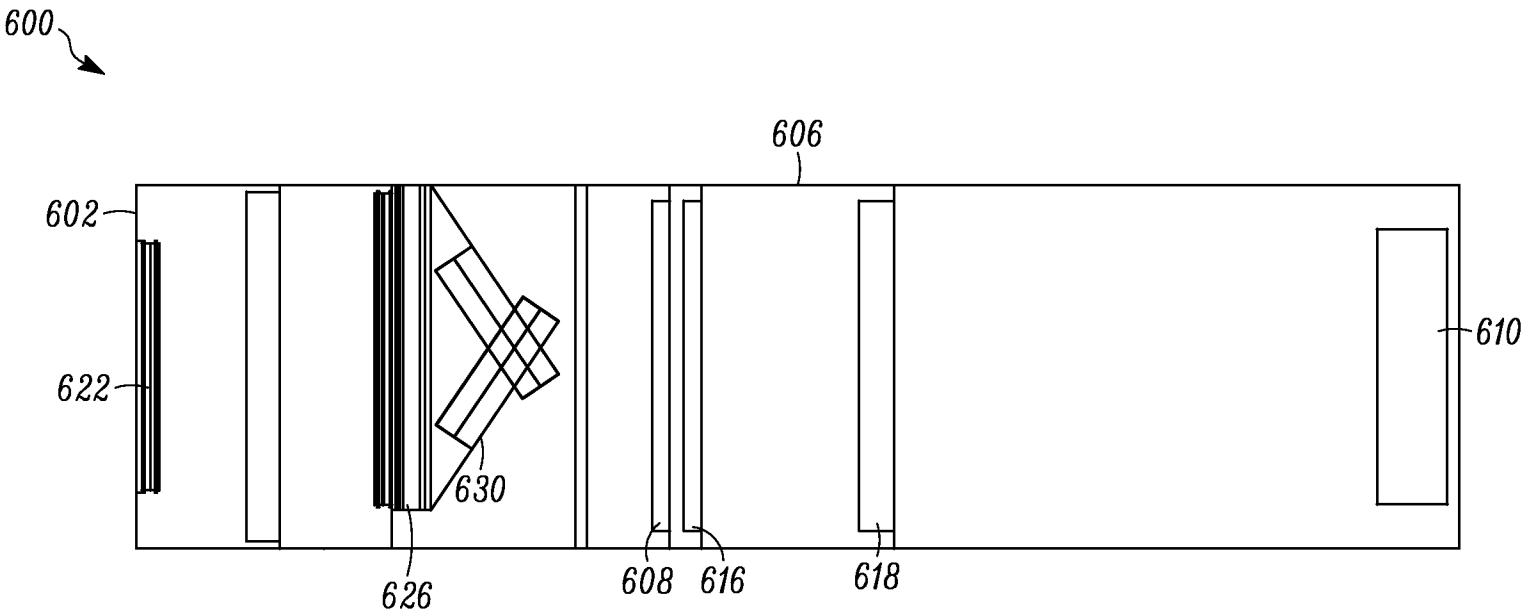

FIGS. 6A-C show another embodiment of an air flow mixer, which may be implemented for example to address side-to-side temperature imbalances, which may occur in air moving equipment.

Figure 7:
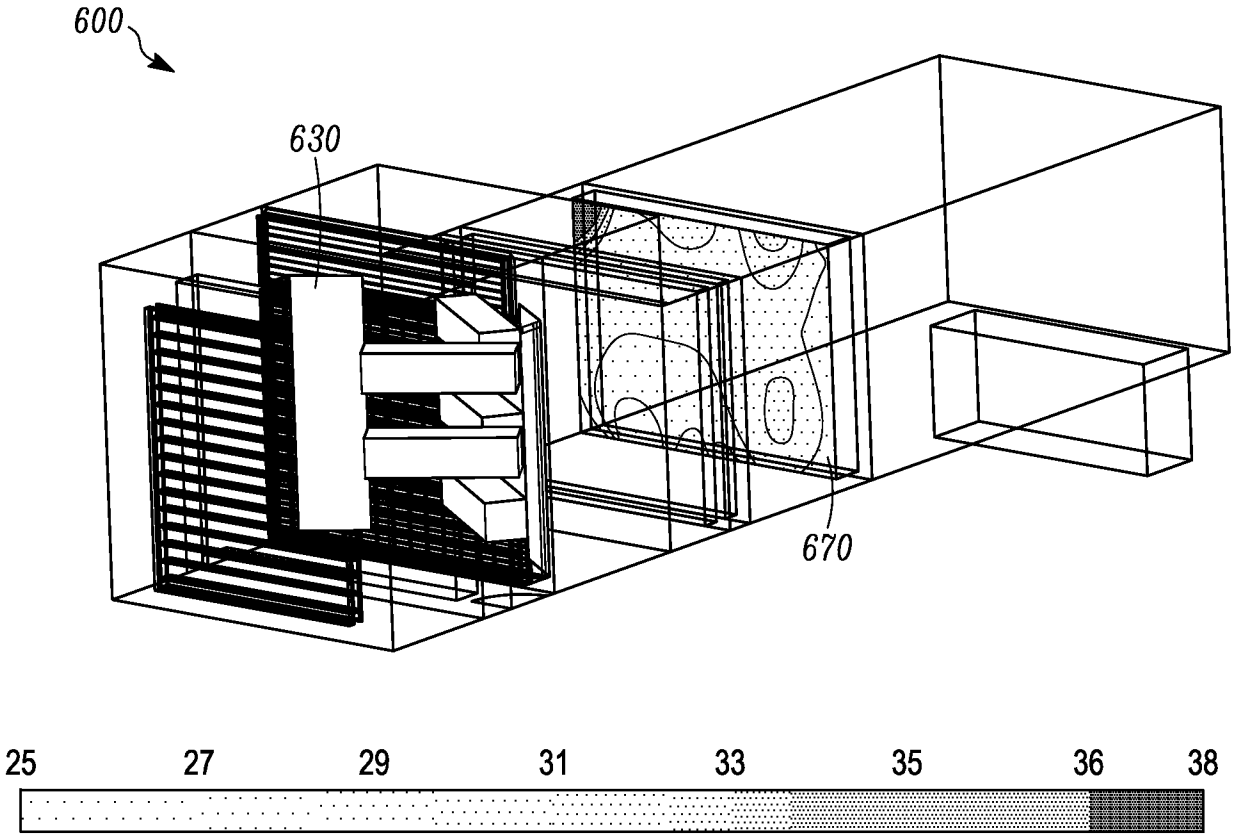

FIG. 7 shows an air temperature distribution for example of a cooling coil downstream resulting from the use of the air flow mixer of FIGS. 6A to C.

Figure 8:
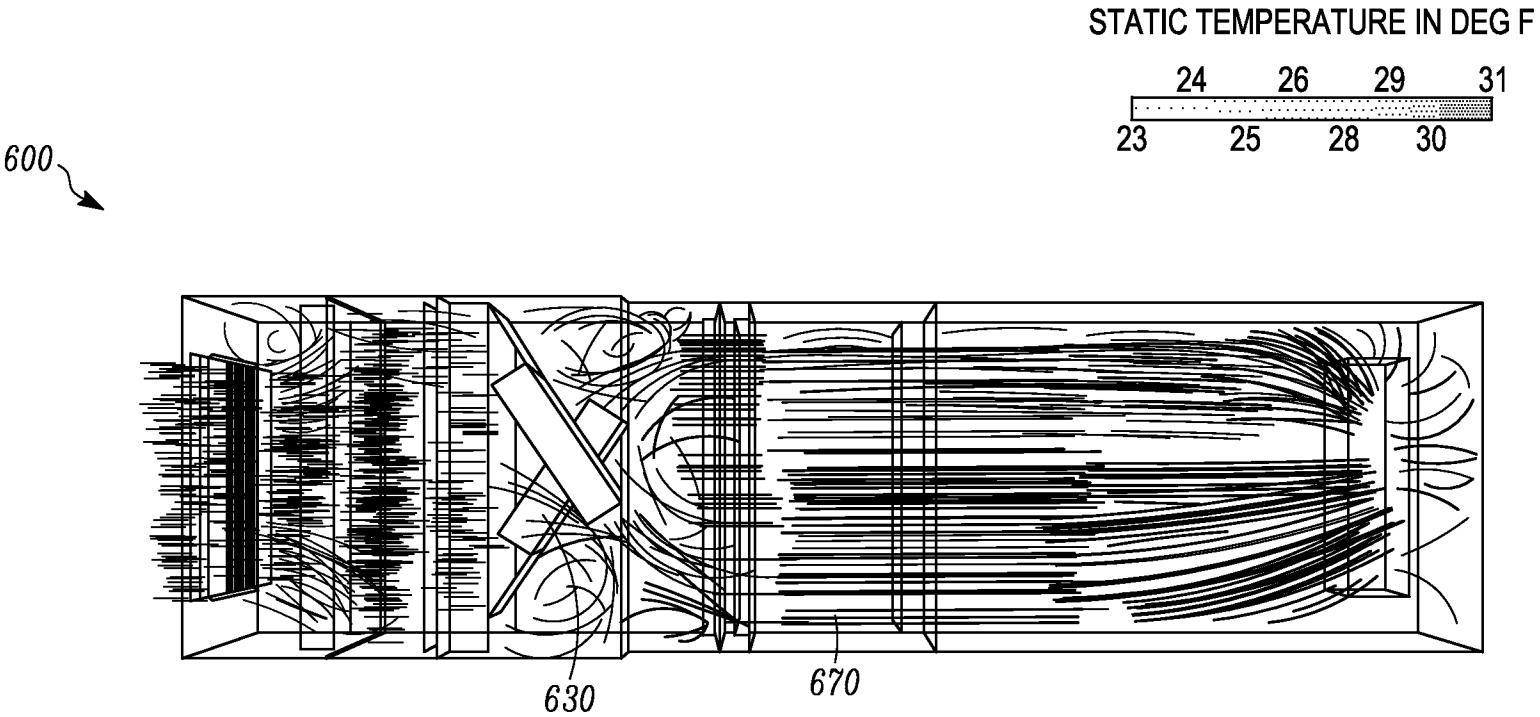

FIG. 8 shows air flow patterns for example through air moving equipment while using the air flow mixer of FIGS. 6A to C.

Figure 9:
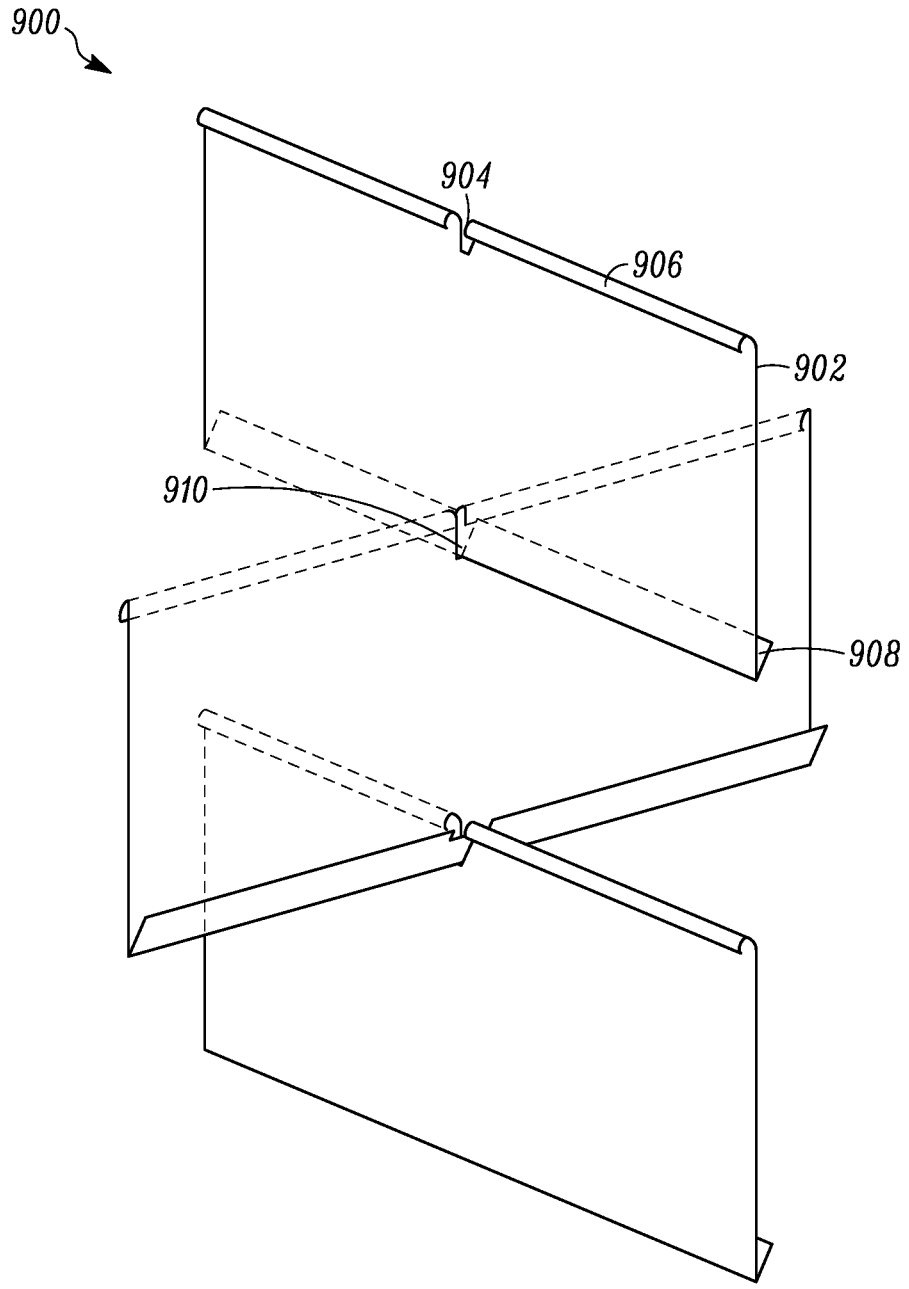

FIG. 9 shows an example of an assembly approach for an air flow mixer, using snap features to fasten members together.

Figure 10:
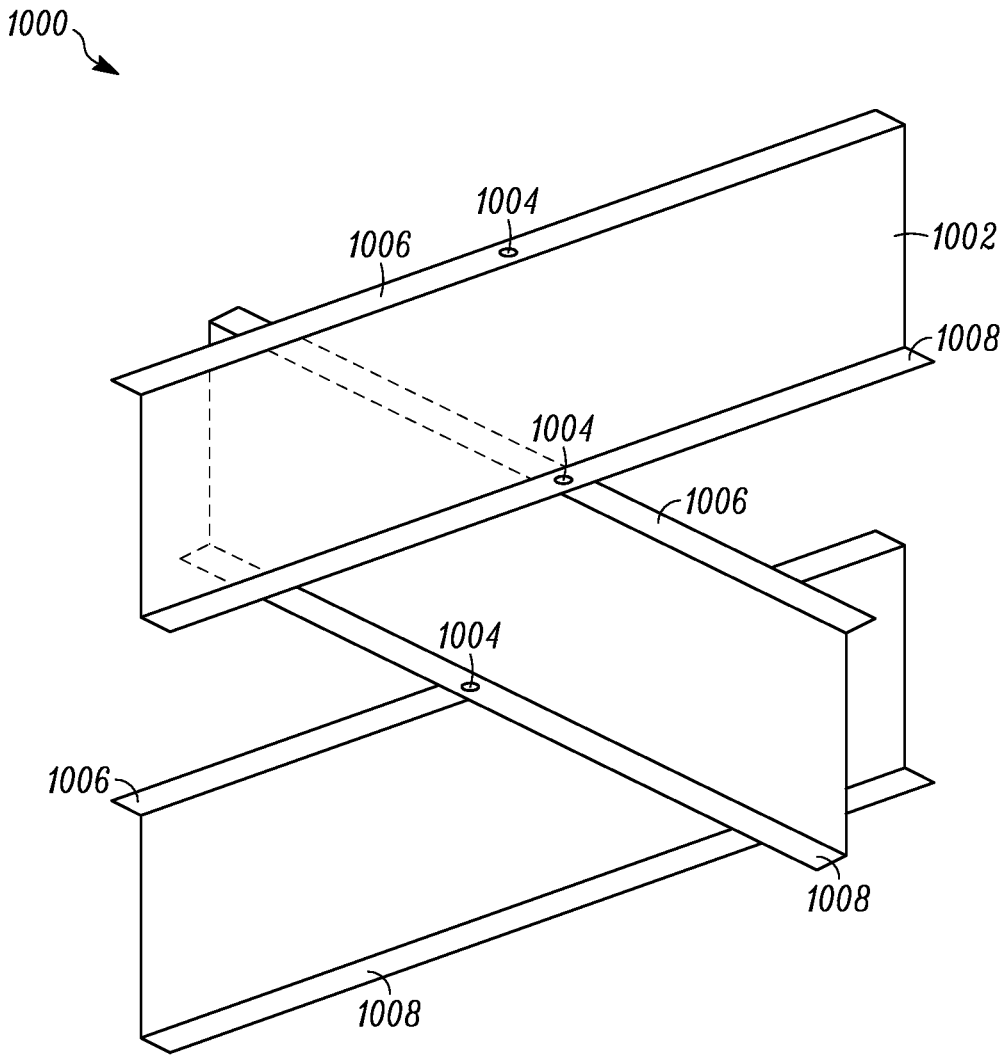

FIG. 10 shows an example of an assembly approach for an air flow mixer, using hardware features to fasten members together.

Figure 11:
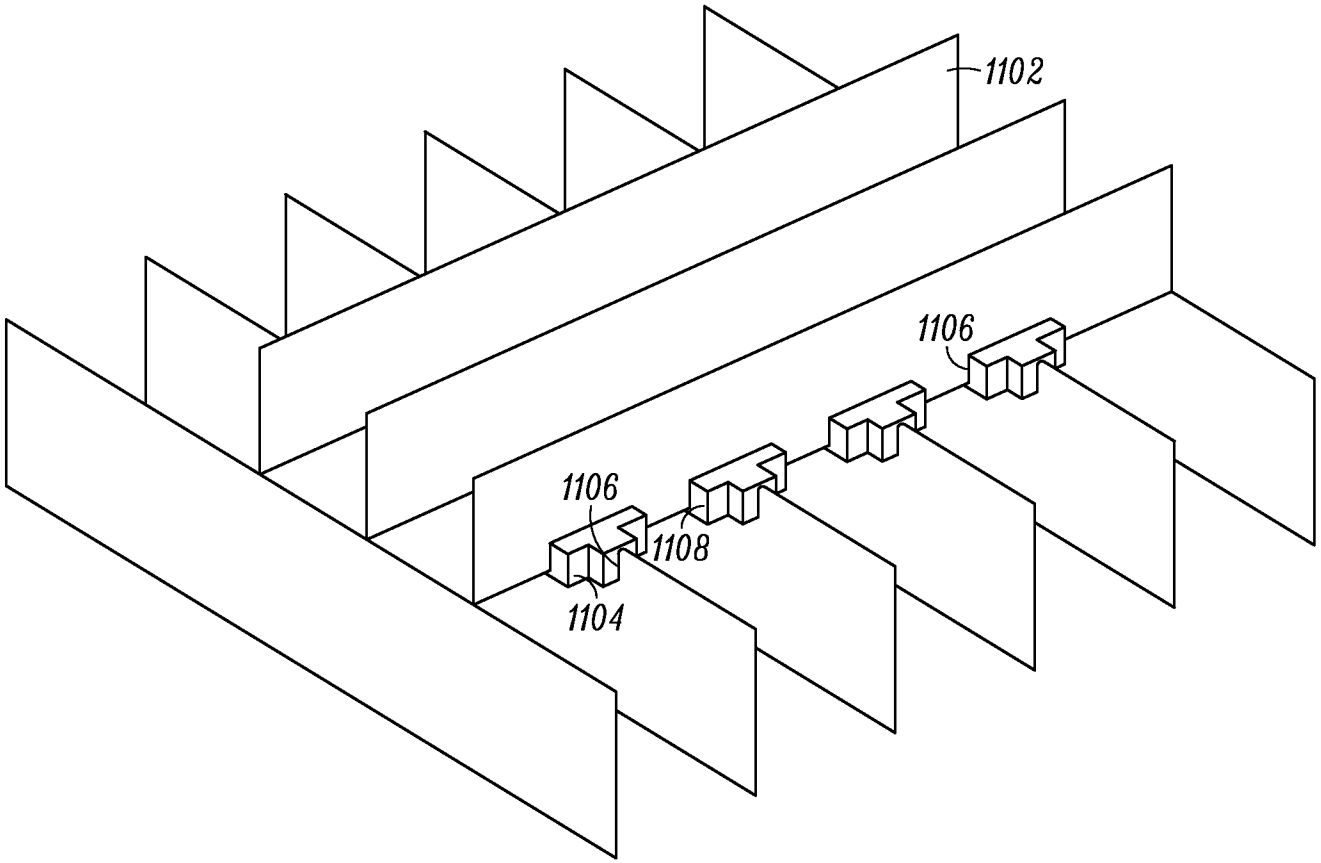

FIG. 11 shows an example of an assembly approach for an air flow mixer, using hardware features, such as for example clips to fasten members together.

Figure 12:
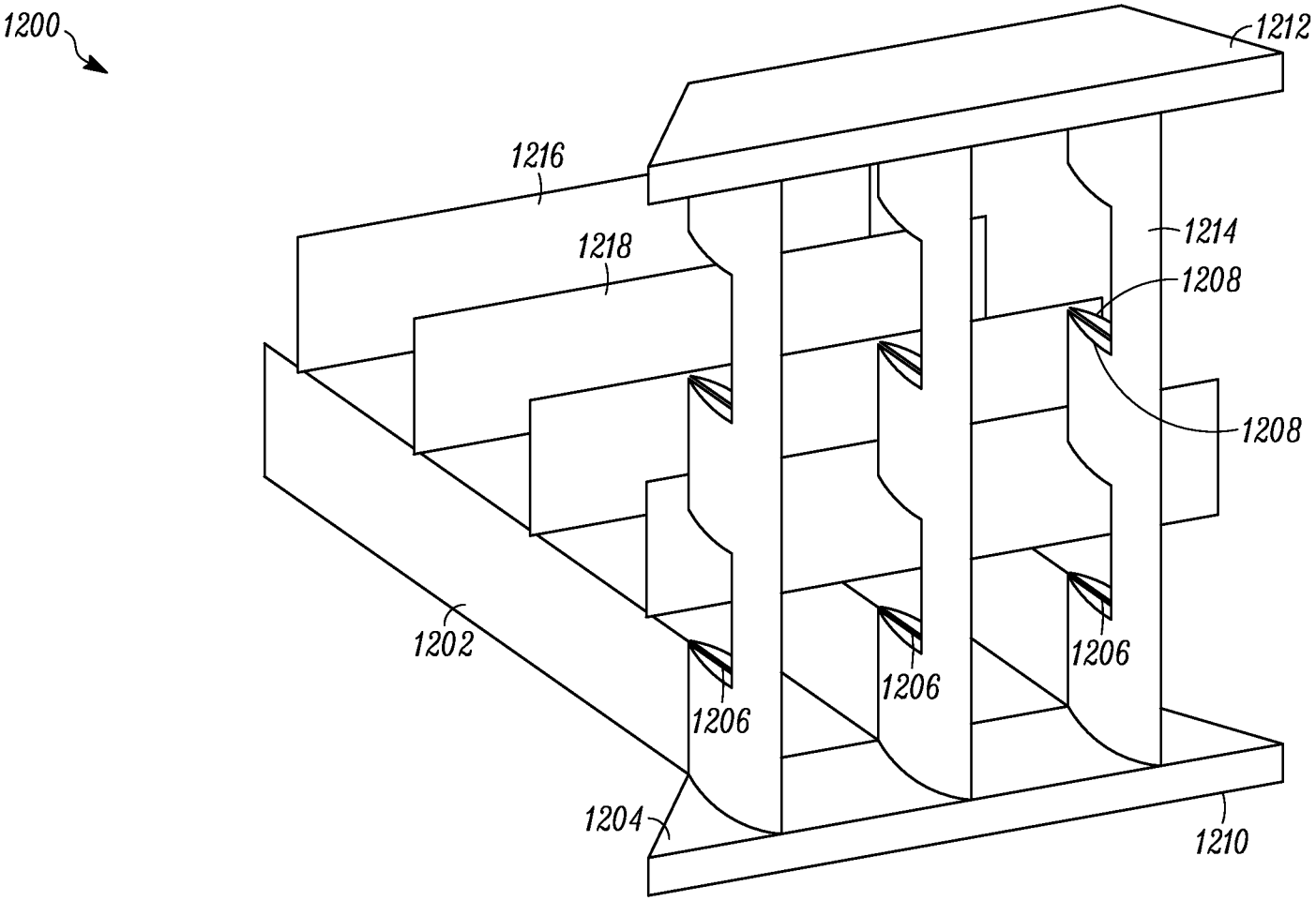

FIG. 12 shows an example of an assembly approach for an air flow mixer, using hardware features, such as for example an end support to fasten members together.

While the above-identified figures set forth particular embodiments of the air flow mixer, other embodiments are also contemplated, as noted in the descriptions herein. In all cases, this disclosure presents illustrated embodiments of the air flow mixer by way of representation but not limitation. Numerous other modifications and embodiments can be devised by those skilled in the art which fall within the scope and spirit of the principles of the air flow mixer described and illustrated herein.

DETAILED DESCRIPTION

The air flow mixers described herein can provide an efficient approach of mixing two air streams which enter air moving equipment at dramatically different temperatures. Such a situation can occur for example in air moving equipment which accepts outdoor air. Such equipment can experience problems such as coil freezing for example when outdoor air is significantly colder relative to return air that is relatively warm and sourced for example from return indoor air. By implementing approaches of cross-flow between portions of the different air streams, sharp delineations or fluid borders, which are created by the natural tendency for air streams at different temperatures to segregate from others and generally remain within themselves, can be avoided and/or eliminated. Other potential problems can include unit control difficulties and/or unit operational performance inefficiencies.

Embodiments disclosed herein relate generally to an air flow mixer that mixes two or more air streams that may enter air moving equipment at significantly different temperatures. In particular, methods, systems and apparatuses are disclosed that are directed to an air flow mixer that is structured and arranged to promote cross flow of portions of the air streams relative to each other through the air flow mixer. The cross flow resulting from the structure and arrangement of the air flow mixer avoids sharp delineations or fluid borders between the air streams which can often arise in the course of air flowing through the unit, and which may occur, for example, in the presence of a relatively higher temperature of one of the air streams and a relatively lower temperature of another one of the air streams.

Figure 1:
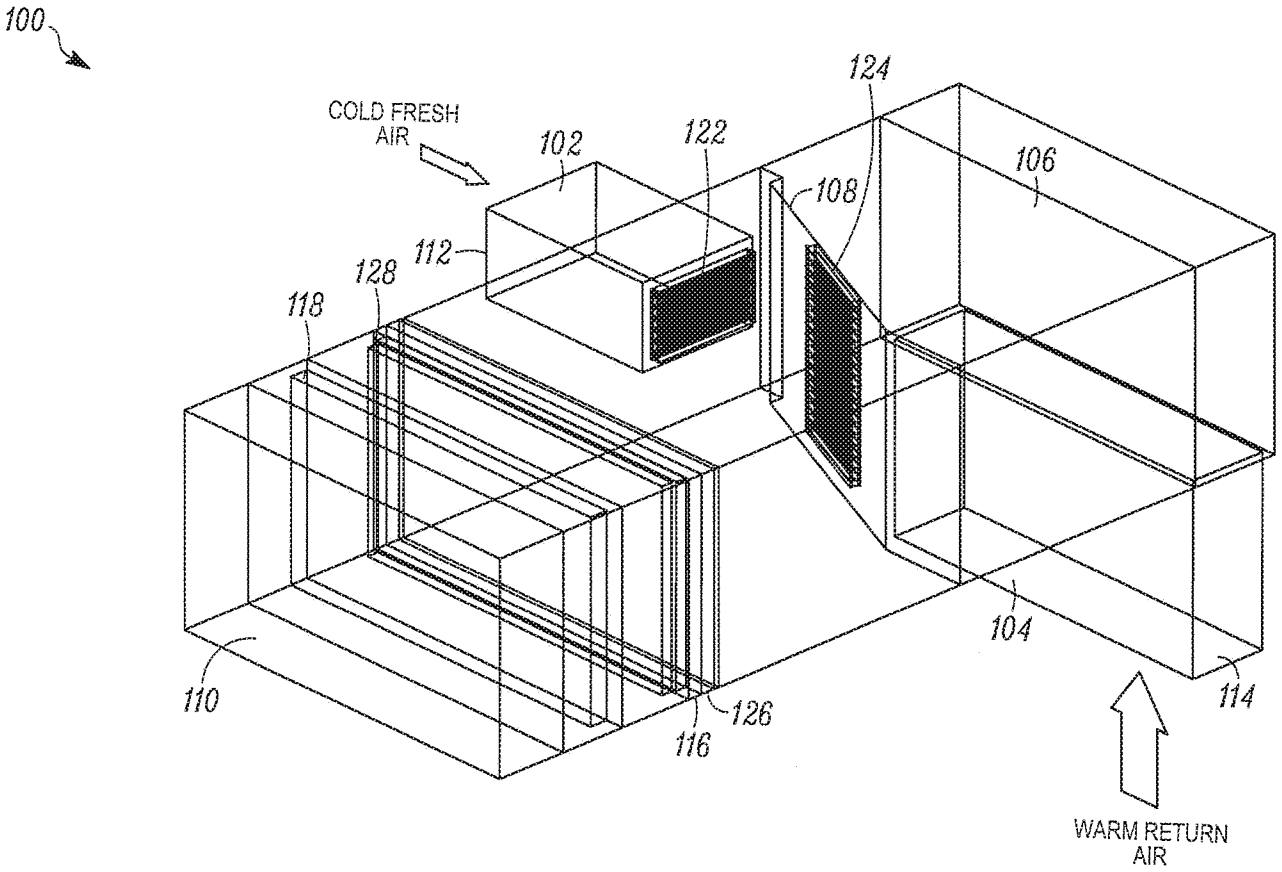
FIG. 1 PRIOR ART
FIG. 1 is a perspective view of one example of a typical air handler unit configuration showing the inside of the air handler unit through an exemplary wall, air flow, and duct structure.

FIG. 1 is a perspective view of one example of a typical air handler unit configuration 100 showing the inside of the air handler unit through an exemplary structure with ducts, in-unit ducts with walls and designed air flow path(s) shown by items 102, 104, and 106. As shown, the air handler unit configuration can include an inlet 112 from duct 102, and another inlet 114 from duct 114. In one embodiment, the inlet 112 is for fresh air, which may be relatively colder compared to the air from inlet 114, which may be relatively warmer and be sourced from return air from a conditioned space or medium that has exchanged heat with the air flowing through inlet 114.

In some embodiments, one or more of the inlets 112, 114 can include respective dampers 122 and 124 which modulate the air flow through the inlets 112, 114. As shown, damper 114 is oriented by use of one or more panels 108, which assist to position and direct air flow through the inlet 114 into the main in-unit duct 106.

In some embodiments, the air handler unit 100 includes a filter 126 downstream of the dampers 122, 124. The air handler unit 100 in some embodiments can include one or more coils 116, 118, (e.g. heating and cooling coil respectively) and/or a humidifier 128, one or more of which is located downstream of the filter 126 as shown in FIG. 1. Outlet 110 is further downstream and exits air from the air handler unit 100.

It will be appreciated that, while the air handler unit 100 may be further referred to herein below, air handler units and other types of air moving equipment may be configured differently than the specific configuration as shown in FIG. 1. And that any later reference to air handler unit and/or air moving equipment and/or heat pipe and the like is not meant to be limited to the configuration as shown in FIG. 1 or any later described Figure.

In a typical air handler unit such as shown in FIG. 1, coil freezing can be a risk such as when low temperature fresh air conditions are present. Other potential problems from the temperature variations can include unit control difficulties and/or unit operational performance inefficiencies.

Figure 2B:
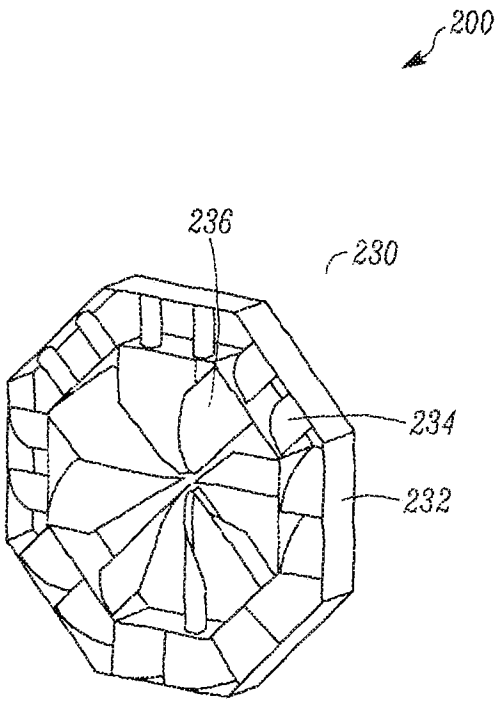
FIG. 2B PRIOR ART
FIGS. 2A and 2B show one example of a known air blender implemented for example in the air handler unit configuration of FIG. 1.
Figure 2A:
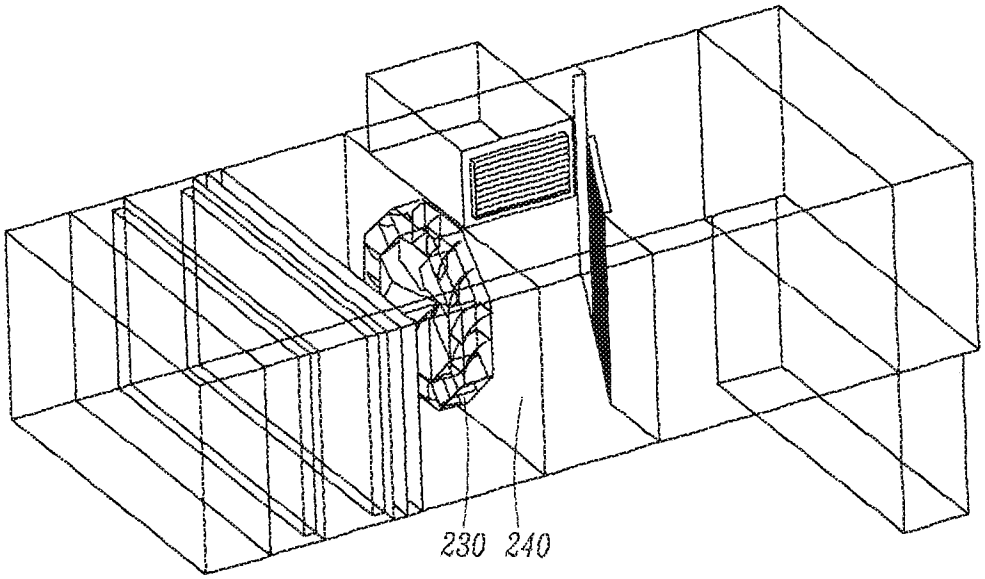
FIG. 2A PRIOR ART

FIGS. 2A and 2B show one example of an air handler unit 200 having a known air blender 230, implemented for example in the air handler unit configuration of FIG. 1. Like reference numbers are not further described. FIG. 2A is a perspective view showing the air handler unit 200 with the air blender 230 and FIG. 2B is a perspective view of the air blender 230 alone. As shown in FIGS. 2A and B, the air blender has a general frame 232 with multiple vanes 234, 236 that curve and turn, for example one ring of the vanes 234 curve and turn relatively clockwise, while the other ring of vanes 236 turn relatively counter clockwise. The turning of the vanes contributes to blending of two or more air streams that flow through the main in-unit duct 106, for example after passing the dampers 122, 124. As the air streams flow through the air blender 230, the air flows get blended to distribute the different temperatures that would likely exist in the different air flow streams.

While such air blenders as the air blender 230 shown in FIGS. 2A and 2B may be useful to blend the different air flows and avoid freezing issues, such air blenders 230 increase unit length, and can be expensive. For example, the air blender 230 shown in FIGS. 2A and 2B, can increase the footprint of the overall unit (e.g. 200 relative to 100) by about 20% in length in order to accommodate it.

FIGS. 3A to C show examples of an air flow mixer 330 according to the inventive concepts and principles herein. FIG. 3A is a perspective view of an air flow mixer 330 implemented in an air handler unit 300, which may have a similar configuration as the air handler unit 100 of FIG. 1. FIG. 3B is a relative close-up perspective view of the air flow mixer 330 shown in FIG. 3A. FIG. 3C shows another embodiment of an air flow mixer 330' having substantially similar features as the air flow mixer 330 shown in FIGS. 3A and 3B.

The air flow mixers, e.g. 330 and 330', herein are structured and arranged to promote cross flow of portions of the air streams relative to each other through the air flow mixer. The cross flow resulting from the structure and arrangement of the air flow mixer avoids sharp delineations or fluid borders between the air streams, and/or removes sharp delineations or fluid borders that may be present between the air streams, and which may be present for example by a relatively higher temperature of one of the air streams and a relatively lower temperature of another one of the air streams.

With particular reference to FIG. 3B, details of air flow mixer 330 are further described. In one embodiment, the air flow mixer 330 includes a frame 331 configured to promote mixing of air flow. The frame 331 includes first members 332 extending in a first direction, and second members 336 extending in a second direction, where in some embodiments such as shown in FIGS. 3A and B, the first and second members 332, 336 can make up the frame. The first direction of the first members 332, in some embodiments, can be oriented relative to the inlet 112 and the second direction of the second members, in some embodiments, can be oriented relative to the inlet 114. The first members 332 are structured and arranged to define first channels 342 through the frame 331. The second members 336 are structured and arranged to define second channels 346 through the frame 331. The first members 332 are structured and arranged to extend across the second direction that the second members 336 extend. The second members 336 are structured and arranged to extend across the first direction that the first members 332 extend. In some but not all embodiments, the first members 332 are structured and arranged to extend at least one of over and under the second channels 346, and the second members 336 are structured and arranged to extend at least one of over and under the first channels 342. The first members 332 include blocking surfaces 344 oriented relative to the second direction, where the blocking surfaces 344 of the first members 332 are configured to block air flow along the second direction over and under the second channels 346. The second members 336 include blocking surfaces 348 oriented relative to the first direction, where the blocking surfaces 348 of the second members 336 are configured to block air flow along the first direction over and under the first channels 342. It will be appreciated that there may also be heat transfer from member to air flow through the channels and from member to member.

In some examples, which will be further described below, the members of the air flow mixer, e.g. members 332, 336, can be structured and arranged into an alternating or interleaved configuration. The members can be structured as blades or blade-like structures to promote air mixing, for example within a limited space. In some embodiments, the air flow mixer includes flow guide panels illustrated as 350 for example in FIG. 3A, which may help direct air flow or streams two the channels 342, 346.

With further reference to FIG. 3A, in some embodiments, the first channels 342 are configured to receive a first air flow or air stream that is generally at one temperature. In some embodiments, this is the air from inlet 112, where fresh air may be sourced, such as for example from outdoor air. In some embodiments, the second channels 346 are configured to receive a second air flow or air stream that is generally at another temperature. In some embodiments, this is the air from inlet 114, where it is relatively warmer air than the relatively colder air from the inlet 112, and can be sourced for example from a conditioned space or medium which transferred heat to the air flowing through inlet 114.

In some embodiments, the temperature of the first air flow and the temperature of the second air flow may differ by, for example but not limited to, several tens of degrees, e.g. degrees Fahrenheit.

In FIG. 3B, the first channels 342 in some embodiments are configured to allow air flow at the one temperature, and the second channels 346 are configured to allow air flow at another temperature, where as shown in the first channels 342 are adjacent to the second channels 346. In some embodiments, the air flow through any one channel of the first channels 342 is exposed to the air flow through any one or more of the channels of the second channels 346. In some embodiments, the air flow through any one channel of the second channels 346 is exposed to the air flow through any one or more of the channels of the first channels 342.

In FIG. 3B, the first channels 342 in some embodiments, create streams of air and the second channels 346 create streams of air. The streams of air of the first channels 342 flow over and under the streams of air of the second channels 346, and the streams of air of the second channels 346 flow over and under the streams of air of the first channels 342. See e.g. multiple first channels 342 are over and under the multiple second channels 346 and where multiple second channels 344 are over and under the multiple first channels 342.

In some embodiments, one or more of the first streams of air are exposed to one or more of the second streams of air, and where one or more of the second streams of air are exposed to one or more of the first streams of air. As shown in FIG. 3B for example, the arrangement of the members, e.g. 332, 336, and the respective channels, e.g. 342, 346, defined therebetween allow for above and below exposure of the channels. See where the members 332 or 336 and the respective channels 342, 346 have a side to side arrangement which configures air streams flowing through the channels 342, 346 to be layered relative to each other. See for example the rows of members 332, the rows of members 336 and their respective channels 342, 346 and how they are alternately layered above and below relative to each other.

Accordingly, in some embodiments, the first streams of air can be configured as one or more layers of air and the second streams of air can be configured as one or more layers of air, where one or more of the layers of air of the first stream are exposed to one or more of the layers of the second stream, and where one or more of the layers of air of the second stream are exposed to one or more of the layers of the first stream.

In some embodiments, the configuration of FIGS. 3A and B, show an air flow mixer that promotes cross flow and intermixing of two or more air flows or air streams, through an interleaved or interweaved structure.

As shown in FIGS. 3A and 3B, in some embodiments, one or both of the arrangement of first members 332 and second members 336 are structured and arranged as several comb-like structures. For example, when viewing the air flow mixer 330 in the length direction L, several "combs" of the second members 336 are arranged from side to side. When viewing the air flow mixer in the height direction H, several "combs" of the second members 336 are arranged in an up and down, or vertical like direction. The first members 332 can have a similar arrangement and construction, but oriented so that the "combs" cross with the "combs" of the second members 336.

It will be appreciated that the members 332, 336 can be constructed and arranged in numerous ways and approaches so as to optimize the air mixing results. For example, the first and second members 332, 336 can each include a length dimension L, as well as a height dimension H, such as referenced for second members 336. It will also be appreciated that the first and second members include a thickness dimension T as well as a relative distance D between adjacent members. It will be appreciated that L, H, T, and D can vary among members 332, 336, and dimensions such as T and D can vary within any single member 332, 336.

It will also be appreciated that the arrangement of any one of the first members 332 can have relative angles with respect to one of the second members 336. For example, an angle $\alpha$ may be the relative angle of an inner side of one of the first members 332 to a top or bottom edge of an adjacent second member 336. In another example, an angle $\beta$ may be the relative angle of a top or bottom edge of one of the first members to an inner side of an adjacent second member 336. As shown these angles resemble perpendicular angles or angles at or about 90 degrees. It will be appreciated that such angles can vary as needed and/or desired.

In some embodiments, any one or more of the first members and the second members are structured and arranged to include perforations 352 therethrough, where the perforations 352 can vary by size, shape, and/or density among various members 332, 336, and/or within any single member 332, 336.

With further reference to FIGS. 3A and 3B, in some embodiments, one or both of the first members 332 and second members 336 are structured and arranged as blade or blade-like structures. In some embodiments, several blades (e.g. members 332, 336) are respectively arranged upwardly and from side to side, where the channels 342, 346 are defined by the spacing of the blades.

With reference to a blade or blade-like structure, in some embodiments, the blades such as shown in FIGS. 3A and 3B can be rectangular and made of solid material. It will also be appreciated that the blades can be perforated such as described above. The set or assembly of blades associated with two or more air streams, for example coming from respective ducts, promote cross-flow. For example the cross flow can be an interweave or interleave, such as the comb-like structure shown in FIGS. 3A and 3B. The blades promote mixing of the different air streams by guiding flow from one air stream into another.

It will be appreciated that numerous embodiments are possible in which the members 332, 336, whether as blades or not as blades, can be configured and arranged. The members 332, 336 can be shaped to have any one or more of e.g. a straight, curved, and/or twisted shaped, and/or have a cross section that is one or more of a straight, curved, and/or air foil cross section. It will also be appreciated that the members 332, 336 can be made of various materials including for example but not limited to sheet metal, composites, plastics and which may or may not have certain perforations or relative porosity.

The relative numbers, sizes, shapes, cross sections, orientations, materials used, and/or porosity (where perforations are used), and including relative parameters thereof, can be optimized to achieve desired performance, such as for example to achieve desired coil temperatures, e.g. minimum coil temperatures, and to achieve desired temperature redistribution downstream of the coil. The air flow mixers herein can lessen the chance for problems such as coil freezing and possibly improve coil performance by making the temperature distribution more uniform. For example temperatures below freezing can be eliminated or at least reduced from entering the coil and flowing farther or significantly farther downstream. It will be appreciated that any of the air flow mixers herein may be configured differently from hard ducts used as outers for a unit, e.g. 102, 104, 106 described above. It will also be appreciated that any of the air flow mixers herein can promote mixing internal to the air flow mixer with a varying degree of mixing depending on the specific configuration. Generally, the air flow mixers herein encourage the cross flow of air streams at different temperatures, where there can be intermingling of jets of air created by the air flow mixer so as to balance temperature distribution.

In some embodiments, any of the air flow mixers herein and structures thereof may be implemented in air moving equipment, such as may be used in an HVAC unit and/or system. Air moving equipment can include but is not limited to various air handling units and/or systems and various heat pipe units and/or systems.

It will be appreciated that the members 332, 336 of the air flow mixer 330 or any of the air flow mixers described and shown herein can be fixed within the particular unit, e.g. air handler 300, into which they are installed. In some embodiments, the members 332, 336 can be introduced at each discharge duct, e.g. at inlets 112, 114. In some embodiments, the channels 342, 346 can be respectively parallel to the flow direction where air exits the duct, e.g. ducts 102, 104, into the inlets 112, 114 of the in-unit duct 106.

Accordingly, in some embodiments, any of the air flow mixers herein and structures thereof may be located or otherwise disposed at inlets or proximate inlets of two or more air flows, for example at an intersection or junction area downstream of the inlets. In some embodiments, any of the air flow mixers may be upstream of a heat exchange coil and within in-unit duct structures, e.g. 330 is within 106 and upstream relative to coils 116 and 118. In some embodiments, such in-duct structures are existing in-unit duct structures, e.g. 106, where no additional duct is needed.

FIG. 3C shows another embodiment of an air flow mixer 330' having substantially similar features as the air flow mixer 330 shown in FIGS. 3A and 3B.

As with the air flow mixer 330 of FIGS. 3A and 3B, the air flow mixer 330' of FIG. 3C is structured and arranged to be an interleaved blade air flow mixer for mixing two air streams which can enter air moving equipment, such as an air handler 300'. The air handler 300' can have a duct 302' fluidly connected to the inlet 312' and a duct 304' fluidly connected to the inlet 314', where dampers 322' and 324' are respectively located at the inlets 312' and 314'. The inlets 312' and 314' are part of the in-unit duct 306'. As shown, the interleaved blade air flow mixer helps break up a natural tendency of different air streams to segregate themselves.

With further reference to FIG. 3C, the air flow mixer 330' includes a series of members 332' and 336', which may be constructed and arranged as fixed blades, and can vary in the same ways as described above with respect to members 332, 336. The members 332' and 336' as shown are disposed at each discharge duct 302', 304' and as shown can be parallel to the flow direction where air exits the ducts 302', 304'. The members 332', 336' (blades) respectively associated with one duct exit and the blades associated with an adjacent duct exit interweave with each other. As a result, the blades promote mixing of the different air streams by guiding flow from one air stream into another.

It will be appreciated that with any of the air flow mixers herein, the size of the in-unit ducts can be made larger to suitably address (e.g. reduce) pressure drop that may be caused by the air flow mixer. It will be appreciated that such considerations of increasing the size of in-unit ducts may be dependent on certain desired and/or necessary design optimizations, but where additional space may be needed to accommodate such increases, use of the air flow mixer herein would help minimize the overall increase in footprint relative to certain air blenders, e.g. as shown in FIGS. 2A and B.

FIGS. 4A-C show simulated air flow patterns and coil temperature distributions. The results shown are from simulations based on for example computational fluid dynamics (CFD) flow simulation. FIG. 4A shows air flow patterns and temperature distributions in a conventional baseline unit (e.g. as in FIG. 1) without an air blender or air flow mixer. FIG. 4B shows air flow patterns and temperature distributions in a unit that has an air blender (e.g. as in FIGS. 2A and 2B). FIG. 4C shows air flow patterns and temperature distributions in a unit that has an air flow mixer as described herein (e.g. as in FIGS. 3A to 3C).

In FIG. 4A, air flow patterns and temperature distributions are shown in a conventional baseline unit (e.g. as in FIG. 1) without an air blender or air flow mixer. As shown, the air flow patterns and coil distributions range from relatively low temps of a minimum temperature at or about −3.0 F to a maximum temperature or high temps at or about 72 F. Without the use of an air blender or an air flow mixer, the mix effect is very small, e.g. 0.03, but where relative static pressure is kept low, e.g. at or about 1.36 in (inches of water column), due to the lack of additional structure that would increase pressure drop, e.g. air blender or air flow mixer. However, the air flow patterns and coil distributions show very sharp changes in temperature, e.g. sharp delineations or fluid borders, which can make coils susceptible to freezing, for example in the presence of very low outdoor temperatures.

In FIG. 4B, air flow patterns and temperature distributions are shown in a unit that has a conventional air blender (e.g. as in FIG. 2). As shown, the air flow patterns and coil distributions range from relatively high minimum temps of at or about 38 F to a maximum temperature of at or about 62 F. With the use of an air blender or an air flow mixer, the mix effect is quite high, e.g. 0.69, and where relative static pressure is maintained relatively low compared to the results shown in FIG. 4A, e.g. at or about 1.50 in. It will be appreciated that the mix effect or mixing effect as for example in the Figs. represents a dimensionless number that indicates the degree of temperature uniformity (e.g. 1.0 being perfectly uniform). However, even with such a high range of differing inlet temperatures, e.g. at tens of degrees F., the air flow patterns and coil distributions showed much more uniform temperature distribution, and relatively less sharp changes in temperature, e.g. sharp delineations or fluid borders as a result of the mixing.

In FIG. 4C, air flow patterns and temperature distributions are shown in a unit that has an air flow mixer as described herein (e.g. as in FIGS. 3A to 3C). As shown, the air flow patterns and coil distributions range from a relatively high minimum temperature of at or about 36 F to a maximum temperature of at or about 64 F. With the use of an air blender or an air flow mixer, the mix effect is also quite high, e.g. 0.64, and where relative static pressure is maintained relatively low compared to the results shown in FIG. 4A, e.g. at or about 1.67 in. However, even with such a high range of differing inlet temperatures, e.g. at tens of degrees F., the air flow patterns and coil distributions showed much more uniform temperature distribution, and had relatively less sharp changes in temperature, e.g. sharp delineations or fluid borders as a result of the mixing.

FIG. 4C shows for example a relatively shorter unit, e.g. when compared to the unit of FIG. 4B, by using the air flow mixer of FIGS. 3A to C, and that has performance comparable to an air blender in the same type of unit.

FIG. 5 shows a side-to-side temperature imbalance 570, for example that may occur in air moving equipment 500, which includes for example a heat pipe. In the embodiment as shown in FIG. 5, a heat pipe is incorporated into air moving equipment 500, such as for example within an air handler unit, and where the heat pipe can be susceptible to uneven temperature distribution, e.g. side to side imbalance, when in operation. The results shown are from simulations based on for example computational fluid dynamics (CFD) flow simulation, where the cooling coil temperature. The baseline air moving equipment in this example admits 30,000 CFM of inlet air at or about 23° F. As shown, the coil temperature distribution is characterized with relatively sharp changes in temperature, e.g. sharp delineations or fluid borders, where minimum coil temperatures were at or about 25 F and maximum coil temperatures were at or about 38 F. See e.g. arrow and 570 on FIG. 5.

FIGS. 6A-C show another embodiment of an air flow mixer 630 which includes a mixing section. The air flow mixer 630 may be implemented to address side-to-side temperature imbalances that may occur in air moving equipment 600, such as for example that may incorporate the heat pipe 500 in FIG. 5. FIG. 6A shows a partial perspective view of the air flow mixer 630 implemented into air moving equipment 600, similar to FIG. 5. FIG. 6B shows a close-up view thereof focusing on the air flow mixer 630. FIG. 6C shows a top view thereof. The air moving equipment 600 can include an inlet duct 602 and damper 622 that are fluidly connected to the in-unit ducting 606, and where a filter 626 can be downstream of the damper 622. In the embodiment shown, the air flow mixer 630 can be downstream of the filter 626. Downstream of the air flow mixer 630 in the embodiment shown, the heat pipe 600 includes humidifier 628 and a heating coil 616, and then a cooling coil 618 respectively.

The air flow mixer 630 can incorporate side flow deflectors or directors, such as suitable panels to get air moving toward the center and to an interleaved duct structure, with some similar features as the air flow mixers, e.g. 330, 330', but with fewer members (e.g. blades). The features of the air flow mixer 630 are further described below, and where the air flow mixer 630 includes additional transfer columns which are also further described below, and which help promote cross flow of air from one side to the other.

With reference to FIG. 6B, the air flow mixer 630 is shown according to the inventive concepts and principles herein. The air flow mixer 630 is structured and arranged to promote cross flow of portions of the air streams relative to each other through the air flow mixer 630. The cross flow resulting from the structure and arrangement of the air flow mixer 630 avoids sharp delineations or fluid borders between the air streams, and/or removes sharp delineations or fluid borders that may be present between the air streams, which can be caused for example by a relatively higher temperature of one of the air streams and a relatively lower temperature of another one of the air streams.

With particular reference to FIG. 6B, details of the air flow mixer 630 are further described. In one embodiment, the air flow mixer 630 includes a frame 631 configured to promote mixing of air flow. The frame 631 includes first members 632 extending in a first direction, and second members 636 extending in a second direction, where in some embodiments such as shown in FIG. 6B, the first and second members 632, 636 can make up part of the frame 631. The first direction of the first members 632 and the second direction of the second members 636, in some embodiments, can be oriented relative to the inlet duct 602, which can have a damper 622. In the embodiment shown, two or more air streams are exiting the inlet duct 602, through the damper 622, and into the in-unit ducting 606. Where the air flow or streams have significantly different temperatures, such side to side imbalances as described above can be present. The first members 632 are structured and arranged to define first channels 644 through the frame 631. The second members 636 are structured and arranged to define second channels 646 through the frame 631. One or more of the first members 632 are structured and arranged to extend across the second direction that the second members 636 extend and to extend over and under the second channels 646. One or more of the second members 636 are structured and arranged to extend across the first direction that the first members 632 extend, and to extend over and under the first channels 644. The first members 632 and the second members 636 include blocking surfaces oriented relative to an air flow area 670, where the blocking surfaces of the first members 632 and the second members 636 are configured to block air flow passing from the air flow area 670 but allow air flow through openings 680.

In some examples, which will be further described below, the members of the air flow mixer, e.g. members 632, 636, can be structured and arranged into an alternating or interleaved configuration. The members can be structured as blades or blade-like structures to promote air mixing, for example within a limited space. In some embodiments, the air flow mixer includes flow guide panels illustrated as 650 for example in FIG. 3A, which may help direct air flow or streams to the channels 644, 646 and are further described below.

With further reference to FIG. 6B, in some embodiments, the first channels 644 are configured to receive a first air flow or air stream that is generally at one temperature range such as may occur in a side to side temperature imbalance. In some embodiments, the second channels 646 are configured to receive a second air flow or air stream that is generally at another temperature range.

In some embodiments, the temperature of the first air flow and the temperature of the second air flow may differ by, for example but not limited to, several tens of degrees, e.g. degrees Fahrenheit.

In FIG. 6B, the first channels 644 in some embodiments are configured to allow air flow at the one temperature, and the second channels 646 are configured to allow air flow at another temperature, where as shown in the first channels 644 are adjacent to one or more of the second channels 646, and the second channels are adjacent to one or more of the first channels 644.

As shown in FIG. 6B, in some embodiments, one or both of the arrangement of first members 632 and second members 636 are structured and arranged as several comb-like structures. In the embodiment shown, when viewing the air flow mixer 630 in the length direction $L_6$, two "combs" of the first members 632 are arranged from side to side. The second members 636 can have a similar arrangement and construction, but oriented so that the two "combs" of the second members 636 cross with the two "combs" of the first members 632.

It will be appreciated that the members 632, 636 can be constructed and arranged in numerous ways and approaches so as to optimize the air mixing results. For example, the first and second members 632, 636 can each include a length dimension L, as well as a height dimension $H_6$, such as referenced for first members 632. It will also be appreciated that the first and second members include a thickness dimension $T_6$ as well as a relative distance D between adjacent members. It will be appreciated that $L_6$, $H_6$, $T_6$, and D can vary among members 632, 636, and dimensions such as $T_6$ and D can vary within any single member 632, 636.

It will also be appreciated that the arrangement of any one of the first members 632 can have relative angles with respect to one of the second members 636. For example, an angle $\alpha_6$ may be the relative angle of a side of one of the first members 632 that crosses with a side of an adjacent second member 636. In another example, an angle $\beta_6$ may be the relative angle of a top or bottom edge of one of the first members 632 to an inner side of an adjacent second member 636. As shown these angles resemble obtuse and perpendicular angles, respectively. It will be appreciated that such angles can vary as needed and/or desired.

In some embodiments, any one or more of the first and second members 632 and 636 include a top cover or panel 660. In some embodiments, one or both of the first members and second members include a bottom cover or panel similarly constructed as and opposite of 660. In some embodiments, where both the top and bottom panel are used for any one channel 644, 646, such channel may resemble a closed channel or structure, where air flow within the channel (e.g. 644, 646) is not exposed to air flow present outside the closed channel. In some embodiments, the channels may be constructed and arranged as columnar type channels that are closed on four sides.

In some embodiments, angle $\gamma$ may be a relative angle of a side of the top cover or panel to a side of one of the members, e.g. 636.

In some embodiments, any of the air flow mixers herein and structures thereof can include one or more panels 650, where the panels 650 are configured as flow directors or guides toward the center of the air flow mixer 630 and into any one or more of the first and second channels 644, 646. An angle $\delta$ may be a relative angle from a lower or upper edge of the bottom or top panel 660 to a side edge of the panel 650. As shown angles $\gamma$ and $\delta$ resemble perpendicular angles, respectively. It will be appreciated that such angles can vary as needed and/or desired.

In some embodiments, the panels 650 include a relative width $W_p$, a relative height $H_p$, and a relative angle $\alpha_p$ that can be an angle of a side of one of the panels 650 relative to a plane of the air flow area 670. As shown, the angle $\alpha_p$ is a relatively acute angle, but it will be appreciated that other angles may be used.

In some embodiments, any one or more of the first members and the second members are structured and arranged to include perforations therethrough, where the perforations can vary by size, shape, and/or density among various members 632, 636 and/or within any single member 632, 636.

With further reference to FIG. 6B, in some embodiments, one or both of the first members 632 and second members 636 are structured and arranged as blade or blade-like structures. In some embodiments, two blades (e.g. members 632, 636) are respectively arranged upwardly and from side to side, where the channels 644, 646 are defined by the spacing of the blades.

With reference to a blade or blade-like structure, in some embodiments, the blades such as shown in FIG. 6B can be rectangular and made of solid material. It will also be appreciated that the blades can be perforated such as described above. The set or assembly of blades associated with two or more air streams, promote cross-flow. For example the cross flow can be an interweave or interleave, such as the comb-like structure shown in FIG. 6B. The blades promote mixing of the different air streams by guiding flow from one air stream into another.

It will be appreciated that numerous embodiments are possible in which the members 632, 636, whether as blades or not as blades, can be configured and arranged. The members 632, 636 can be shaped to have any one or more of e.g. a straight, curved, and/or twisted shaped, and/or have a cross section that is one or more of a straight, curved, and/or air foil cross section. It will also be appreciated that the members 632, 636 can be made of various materials including for example but not limited to sheet metal, composites, plastics and which may or may not have certain perforations or relative porosity.

The relative numbers, sizes, shapes, cross sections, orientations, materials used, and/or porosity (where perforations are used), and including relative parameters thereof, can be optimized to achieve desired performance, such as for example to achieve desired coil temperatures, e.g. minimum coil temperatures, and to achieve desired temperature redistribution downstream of the coil. The air flow mixers herein can lessen the chance for problems such as coil freezing and possibly improve coil performance by making the temperature distribution more uniform. For example temperatures below freezing can be eliminated or at least reduced from entering the coil and flowing farther or significantly farther downstream. It will be appreciated that any of the air flow mixers herein may be configured differently from hard ducts used as outers for a unit, e.g. 102, 104, 106 described above. It will also be appreciated that any of the air flow mixers herein can promote mixing internal to the air flow mixer with a varying degree of mixing depending on the specific configuration. Generally, the air flow mixers herein encourage the cross flow of air streams at different temperatures, where there can be intermingling of jets of air created by the air flow mixer balances the temperature distribution.

In some embodiments, any of the air flow mixers herein and structures thereof may be implemented in air moving equipment, such as may be used in an HVAC unit and/or system. Air moving equipment can include but is not limited to various air handling units and/or systems and various heat pipe units and/or systems. In some embodiments, any of the air flow mixers can be a backfit or retrofit device in an existing air moving equipment.

It will be appreciated that the members 632, 636 of the air flow mixer 630 or any of the air flow mixers described and shown herein can be fixed within the particular unit, e.g. heat pipe 600, into which they are installed. In some embodiments, the channels 644, 646 can be respectively angled relative to the flow direction from flow area 670.

Accordingly, in some embodiments, any of the air flow mixers herein and structures thereof may be located or otherwise disposed at inlets or proximate inlets of two or more air flows, for example at an intersection or junction area downstream of the inlets. In some embodiments, any of the air flow mixers herein may be upstream of a heat exchange coil and within in-unit duct structures or downstream after two or more air flow streams have been put together (e.g. air flow mixer 630 in heat pipe 600).

FIG. 7 shows an air temperature distribution for example on a cooling coil downstream in a heat pipe using the air flow mixer 630 of FIGS. 6A to C. The results shown are from simulations based on for example computational fluid dynamics (CFD) flow simulation, where the air moving equipment admits about 30,000 CFM of inlet air at 23 F. As shown, air flow mixer 630 provide much more uniform temperature distribution than was the case in the baseline unit in FIG. 5, and was relatively even or uniform without sharp changes in temperature, e.g. without sharp delineations or fluid borders, where minimum coil temperatures were at or about 27 F and maximum coil temperatures were at or about 31 F. See e.g. arrow and 670 on FIG. 7. FIG. 7 shows results with dramatic improvement e.g. from a 13 degree F. difference to a 4 degree difference with good distribution.

FIG. 8 shows air flow patterns for example through air moving equipment while using the air flow mixer of FIGS. 6A to C. The results shown are from simulations based on for example computational fluid dynamics (CFD) flow simulation, where the air moving equipment admits about 30,000 CFM of inlet air at 23 F, and which show similar results in flow patterns as in FIG. 7. See e.g. 670 in FIG. 8. The air flow mixer was shown to be effective in shifting for example alternating air jets to opposite sides, thereby promoting air mixing.

FIG. 9 shows an example of an assembly approach 900 for an air flow mixer, using snap features to fasten members together. In FIG. 9, one embodiment is shown of snap together members or blades 902. The members or blades snap together at intersections 910, where a notch 904, which may be formed in a flange 906, on one of a top or bottom of a blade allows a flange 908 on a respective bottom or top of another blade 902 to snap into the respective notched flange 904, 906. It will be appreciated that a suitable joint, e.g. at intersections 910 can be constructed that holds the blades at the respective intersection in a suitably tight enough manner to address shipping and rattling. In some embodiments, an external frame for support may be employed.

FIG. 10 shows an example of an assembly approach 1000 for an air flow mixer, using hardware features to fasten members 1002 or blades together. In FIG. 10, one embodiment of such hardware may be the use of screws or rivets at positions 1004 which may be disposed on top and bottom flanges 1006 and 1008 of each of the blades 1002 at respective positions. In some embodiments, screws or rivets may be used as the fasteners to hold blades together at intersections, e.g. of 1004 of 1006 and 1004 of 1008. In such an embodiment, the assembly approach 1000 can provide a rigid structure, and where connection may not be required at every intersection. In some embodiments, members 1002 may be tied together at certain intersections.

FIG. 11 shows an example of an assembly approach 1100 for an air flow mixer, using clip features 1104 to fasten members 1102 together. In some embodiments, each of the clip features 1104 used can include a clip portion 1106 and a clip portion 1108 which can be respectively used to clip one a member 1102 extending in one direction, and used to clip another member 1102 extending in a different direction. It will be appreciated that due to the structure of some of the members 1102, the entire clip portion is not shown. In one embodiment as shown in FIG. 11, the blades 1102 are clip supported, where the clips hold each blade at the intersection with the one perpendicular to it. Such an assembly approach can provide structural integrity of an air flow mixer, such as to address issues at shipping and/or rattling. Such clips can rely on a firm grip onto the members 1102. In some embodiments, an external frame may be used for additional support. In some embodiments, the clips can be molded.

FIG. 12 shows an example of an assembly approach for an air flow mixer, using an end support 1200 to fasten members 1202 together. In FIG. 12, one embodiment of end supported blades is shown. End structures, which can include a base frame 1210, a top frame 1212, a support 1214 connected to the base frame 1210 and the top frame 1212. The end support 1200 includes clips 1206 with holders 1208 to support the blades 1202. It will be appreciated that the end support can also be used to support the blades in the other direction so that one or more of the end supports are used provides support in the two directions of air flow. In some embodiments, the end supports 1200 for each set of blades may be fastened at corners to create robust mixing assembly. In some embodiments, end support sections may be combined to accommodate sizes for relatively smaller units. It will be appreciated that any of the parts of the end support 1200 can be constructed from one or more molded parts.

It will be appreciated that any one of or combinations of the manufacturing and assembly approaches of FIGS. 9 to 12 are merely exemplary and are not intended to be limiting. There can be various possible approaches and implementations for assembly of the air flow mixers herein, such as for example and not by way of limitation including snaps, notches, screws, rivets, spot welds, clips, use of plastics, composites, or metals, and/or various fittings.

Aspects

Aspects—any of aspects 1-24 to may be combined with any of aspects 25-27, and aspect 25 may be combined with any of aspects 26-27, and aspect 26 may be combined with aspect 27.

1. An air flow mixer comprises:
   - a frame configured to promote mix of air flow, the frame includes
   - first members extending in a first direction, and
   - second members extending in a second direction,
   - the first members are structured and arranged to define first channels through the frame,
   - the second members are structured and arranged to define second channels through the frame, the first members are structured and arranged to extend across the second direction that the second members extend, the second members are structured and arranged to extend across the first direction that the first members extend, the first members include blocking surfaces relative to the second direction, and the second members include blocking surfaces relative to the first direction.

2. The air flow mixer according to aspect 1, wherein the first members are structured and arranged to extend over and under the second channels, and the second members are structured and arranged to extend over and under the first channels.

3. The air flow mixer according to aspect 1, wherein the first channels are configured to receive a first air flow or air stream that is generally at one temperature, the second channels are configured to receive a second air flow or air stream that is generally at another temperature, where the difference of the one temperature and the another temperature is at least tens of degrees Fahrenheit.

4. The air flow mixer according to any of aspects 1 to 3, wherein one or more of the first channels is adjacent to one or more of the second channels.

5. The air flow mixer according to any of aspects 1 to 4, wherein any one channel of the first channels is exposed to any one or more of the channels of the second channels, and any one channel of the second channels is exposed to any one or more of the channels of the first channels.

6. The air flow mixer according to any of aspects 1 to 5, wherein the first channels create streams of air and the second channels create streams of air, the streams of air of the first channels flow over and under the streams of air of the second channels, and the streams of air of the second channels flow over and under the streams of air of the first channels.

7. The air flow mixer according to aspect 6, wherein one or more of the first streams of air are exposed to one or more of the second streams of air, and where one or more of the second streams of air are exposed to one or more of the first streams of air.

8. The air flow mixer according to any of aspects 6 or 7, wherein the first streams of air can be configured as one or more layers of air and the second streams of air can be configured as one or more layers of air.

9. The air flow mixer according to any of aspect 8, wherein the one or more layers of air of the first stream are exposed to one or more of the layers of the second stream, and where one or more of the layers of air of the second stream are exposed to one or more of the layers of the first stream.

10. The air flow mixer according to any of aspects 1 to 9, wherein the air flow mixer promotes cross flow and intermixing of two or more air flows or air streams, through an interleaved or interweaved structure.

11. The air flow mixer according to any of aspects 1 to 10, wherein one or both of the first members and second members are structured and arranged as blade or blade-like structures 12. The air flow mixer according to any of aspects 1 to 11, wherein the blades are arranged upwardly and from side to side, where the first and second channels are defined by the spacing of the blades.

13. The air flow mixer according to any of aspects 1 to 12, wherein one or both of the first members and second members are structured and arranged as several comb-like structures.

14. The air flow mixer according to any of aspects 1 to 13, wherein any one or more of the first members and the second members are structured and arranged to include perforations therethrough.

15. The air flow mixer according to any of aspects 1 to 14, wherein one or more of the first and second members include a top cover or panel 16. The air flow mixer according to any of aspects 1 to 15, wherein one or both of the first members and second members include a bottom cover or panel.

17. The air flow mixer according to any of aspects 1 to 16, wherein any one or more of the first members and second members include both a top and bottom panel for any one channel, such that the respective channel may resemble a closed channel or structure, where air flow within the closed channel is not exposed to air flow present outside the closed channel.

18. The air flow mixer according to any of aspects 1 to 17, further comprising one or more panels, where the one or more panels are configured as flow directors or guides into any one or more of the first and second channels.

19. The air flow mixer according to any of aspects 1 to 18, wherein the air flow mixer may be implemented in air moving equipment in an HVAC unit and/or system.

20. The air flow mixer according to any of aspects 1 to 19, wherein the air moving equipment can include air handling units and/or systems and heat pipe units and/or systems.

21. The air flow mixer according to any of aspects 1 to 20, wherein the air flow mixer herein and structures thereof are disposed proximate inlets of two or more air flows.

22. The air flow mixer according to any of aspects 1 to 21, wherein the air flow mixer herein and structures thereof are disposed proximate an intersection or junction area downstream of inlets of two or more air flows.

23. The air flow mixer according to any of aspects 1 to 2, wherein the air flow mixer herein and structures thereof are disposed upstream of a heat exchange coil and within in-unit duct structures.

24. The air flow mixer according to any of aspects 1 to 23, wherein the air flow mixer herein and structures thereof are disposed within pre-existing in-unit duct structures.

25. An air handler unit according to any of aspects 1 to 24.

26. A heat pipe according to any of aspects 1 to 24.

27. A method of directing flow through an air flow mixer comprising:

directing two or more air flows into an air flow mixer according to any of aspects 1 to 26;

crossing the two or more air flows; and mixing the two or more air flows, wherein the crossing and mixing avoid sharp delineations or fluid borders between the air streams, and/or remove sharp delineations or fluid borders that may be present between the air streams, which can be caused for example by a relatively higher temperature of one of the air streams and a relatively lower temperature of another one of the air streams.

The air flow mixers described herein can provide an efficient approach of mixing two air streams which enter air moving equipment at dramatically different temperatures. Such a situation can occur for example in units of air moving equipment which accepts outdoor air. Such units can experience problems such as coil freezing for example when outdoor air is significantly colder relative to return air that is relatively warm and sourced for example from return indoor air. Such units can also experience unit control difficulties, or be characterized by sub-optimal operational efficiency.

While the embodiments have been described in terms of various specific embodiments, those skilled in the art will recognize that the embodiments can be practiced with modification within the spirit and scope of the claims.

The invention claimed is:

1. An air flow mixer, comprising:

a mixing section, a frame configured to promote mixture of air flow, the frame includes:

a plurality of first members extending in a first direction, a plurality of second members extending in a second direction, wherein the first direction and the second direction are different, the plurality of first members are structured and arranged to each include a top, a bottom, and sides that define enclosed first channels through the frame, wherein air flows through the first channels in the first direction and discharges to the mixing section, the plurality of second members are structured and arranged to each include a top, a bottom, and sides that define enclosed second channels through the frame, wherein air flows through the second channels in the second direction and discharges to the mixing section, wherein the top and the bottom of the plurality of first members are separate structures from the top and the bottom of the plurality of second members, the plurality of first members are each structured and arranged to extend across the second direction that the plurality of second members extend, the plurality of second members are each structured and arranged to extend across the first direction that the plurality of first members extend, the plurality of first members are structured and arranged to extend over and under the second channels in a vertical direction, and the plurality of second members are structured and arranged to extend over and under the plurality of first channels in the vertical direction, a first distance is between two members of the plurality of first members and a second distance is between two members of the plurality of second members, the first distance defines an opening between each of the two members of the plurality of first members, wherein air flows through the opening in a third direction and discharges to the mixing section, the air flow through the opening is physically separate from the air flow through the first channels and the air flow through the second channels, and the second distance defines another opening between two members of the plurality of second members, wherein air flows through the another opening in the third direction and discharges to the mixing section, the air flow through the another opening is physically separate from the air flow through the first channels and the air flow through the second channels, the respective air flows form discrete air flows in different directions when discharged to the mixing section, the plurality of first members include blocking surfaces to block air flow from the second direction, and the plurality of second members include blocking surfaces to block air flow from the first direction.

2. The air flow mixer according to claim 1, wherein the first channels are configured to receive a first air flow or air stream that is generally at one temperature, the second channels are configured to receive a second air flow or air stream that is generally at another temperature, where a difference of the one temperature and the another temperature is different by at least ten degrees Fahrenheit.

3. The air flow mixer according to claim 1, wherein the first channels create first streams of air and the second channels create second streams of air, the first streams of air of the first channels flow over and under the second streams of air of the second channels, and the second streams of air of the second channels flow over and under the first streams of air of the first channels.

4. The air flow mixer according to claim 3, wherein one or more of the first streams of air are exposed to one or more of the second streams of air, and where one or more of the second streams of air are exposed to one or more of the first streams of air.

5. The air flow mixer according to claim 3, wherein the first streams of air are configured as one or more layers of air and the second streams of air are configured as one or more layers of air.

6. The air flow mixer according to claim 5, wherein the one or more layers of air of the first stream are exposed to one or more of the layers of the second stream, and where one or more of the layers of air of the second stream are exposed to one or more of the layers of the first stream.

7. The air flow mixer according to claim 1, wherein the air flow mixer promotes cross flow and intermixing of two or more air flows or air streams, through an interleaved or interweaved structure.

8. The air flow mixer according to claim 1, wherein one or both of the plurality of first members and plurality of second members are structured and arranged as interweave or interleave structures.

9. The air flow mixer according to claim 1, wherein any one or more of the plurality of first members and the plurality of second members are structured and arranged to include perforations therethrough.

10. The air flow mixer according to claim 1, further comprising one or more panels, where the one or more panels are configured as flow directors or guides into any one or more of the first and second channels.

11. An air handler unit comprising the air flow mixer of claim 1.

12. A heat pipe comprising the air flow mixer of claim 1.

13. A method of directing flow through an air flow mixer comprising:

directing two or more air flows into an air flow mixer according to claim 1;

crossing the two or more air flows; and mixing the two or more air flows, wherein the crossing and mixing avoids sharp delineations or fluid borders between the two or more air flows, and/or removes sharp delineations or fluid borders present between the two or more air flows, and caused for example by a relatively higher temperature of one of the two or more air flows and a relatively lower temperature of another one of the two or more air flows.

14. An air flow mixer, comprising:

a mixing section, a frame configured to promote mixture of air flow, the frame includes:

a plurality of first members extending in a first direction and defining enclosed first channels through the frame, wherein air flows through the first channels in the first direction, a plurality of second members extending in a second direction and defining enclosed second channels through the frame, wherein air flows through the second channels in the second direction, wherein the first direction and the second direction are different, wherein the enclosed first channels of the plurality of first members are separate structures from the enclosed second channels of the plurality of second members, the plurality of first members are structured and arranged to extend over and under the second channels in a vertical direction, and the plurality of second members are structured and arranged to extend over and under the first channels in the vertical direction, a first distance is between two members of the plurality of first members, the first distance defines an opening between each of the two members of the plurality of first members, wherein air flows through the opening in a third direction and discharges to the mixing section, the air flow through the opening is physically separate from the air flow through the first channels and the air flow through the second channels, and a second distance between two members of the plurality of second members, the second distance defines another opening between two members of the plurality of second members, wherein air flows through the another opening in the third direction and discharges to the mixing section, the air flow through the another opening is physically separate from the air flow through the first channels and the air flow through the second channels, the respective air flows form discrete air flows in different directions when discharged to the mixing section.

* * * * *